US005469828A

United States Patent [19]

Heimberg et al.

[11] Patent Number: 5,469,828

[45] Date of Patent: Nov. 28, 1995

[54] FUEL INJECTION DEVICE ACCORDING TO THE SOLID-STATE ENERGY STORAGE PRINCIPLE FOR INTERNAL COMBUSTION ENGINES

[75] Inventors: Wolfgang Heimberg, Ebersberg; Wolfram Hellmich, Munich; Franz Kogl, Kaufbeuren, all of Germany; Paul Malatinszky, Bulle, Switzerland

[73] Assignee: Ficht GmbH, Kirschseeonn, Germany

[21] Appl. No.: 295,811

[22] PCT Filed: Mar. 4, 1993

[86] PCT No.: PCT/EO93/00495

§ 371 Date: Sep. 2, 1994

§ 102(e) Date: Sep. 2, 1994

[87] PCT Pub. No.: WO93/18297

PCT Pub. Date: Sep. 16, 1993

[30] Foreign Application Priority Data

Mar. 4, 1992 [DE] Germany ..... 42 06 817.7

[51] Int. Cl.[6] ..... F02M 51/04; F02M 63/06

[52] U.S. Cl. ..... 123/497; 123/499; 123/447

[58] Field of Search ..... 123/497, 498, 123/499, 447

[56] References Cited

U.S. PATENT DOCUMENTS

| | | | |
|---|---|---|---|
| 2,881,749 | 4/1959 | Pringham | 123/497 |
| 4,327,695 | 5/1982 | Schechter | 123/499 |
| 4,338,904 | 7/1982 | Brinkman | 123/499 |
| 4,355,620 | 10/1982 | Seilly et al. | 123/499 |
| 4,584,980 | 4/1986 | Weigner et al. | 123/498 |
| 4,718,386 | 1/1988 | Gieles | 123/499 |
| 4,728,074 | 3/1988 | Igashira et al. | 123/498 |
| 4,958,610 | 9/1990 | Yamamoto et al. | 123/498 |
| 5,078,113 | 1/1992 | Haag et al. | 123/447 |

*Primary Examiner*—Thomas N. Moulis
*Attorney, Agent, or Firm*—Jones & Askew

[57] ABSTRACT

The invention pertains to a fuel injection device operating according to the solid state energy storage principle, whereby a piston element mounted in a pump cylinder of an electromagnetic reciprocating pump, displaces quantities of the fuel to be injected during a virtually resistanceless acceleration phase during which the piston element stores kinetic energy, before the ejection in the pump area. The displacement is stopped suddenly with the means for interrupting the displacement, so that a pressure impulse is generated in the fuel contained in a closed pressure chamber by direct transfer of the stored kinetic energy of the piston element to the fuel in the pressure chamber. The pressure impulse for the ejection of fuel is used by an injection device, whereby the means for interrupting the displacement and producing the pressure impulse are arranged outside the leading liquid-tight contact area between piston element and piston cylinder of the reciprocating pump.

75 Claims, 27 Drawing Sheets

Figure 1:
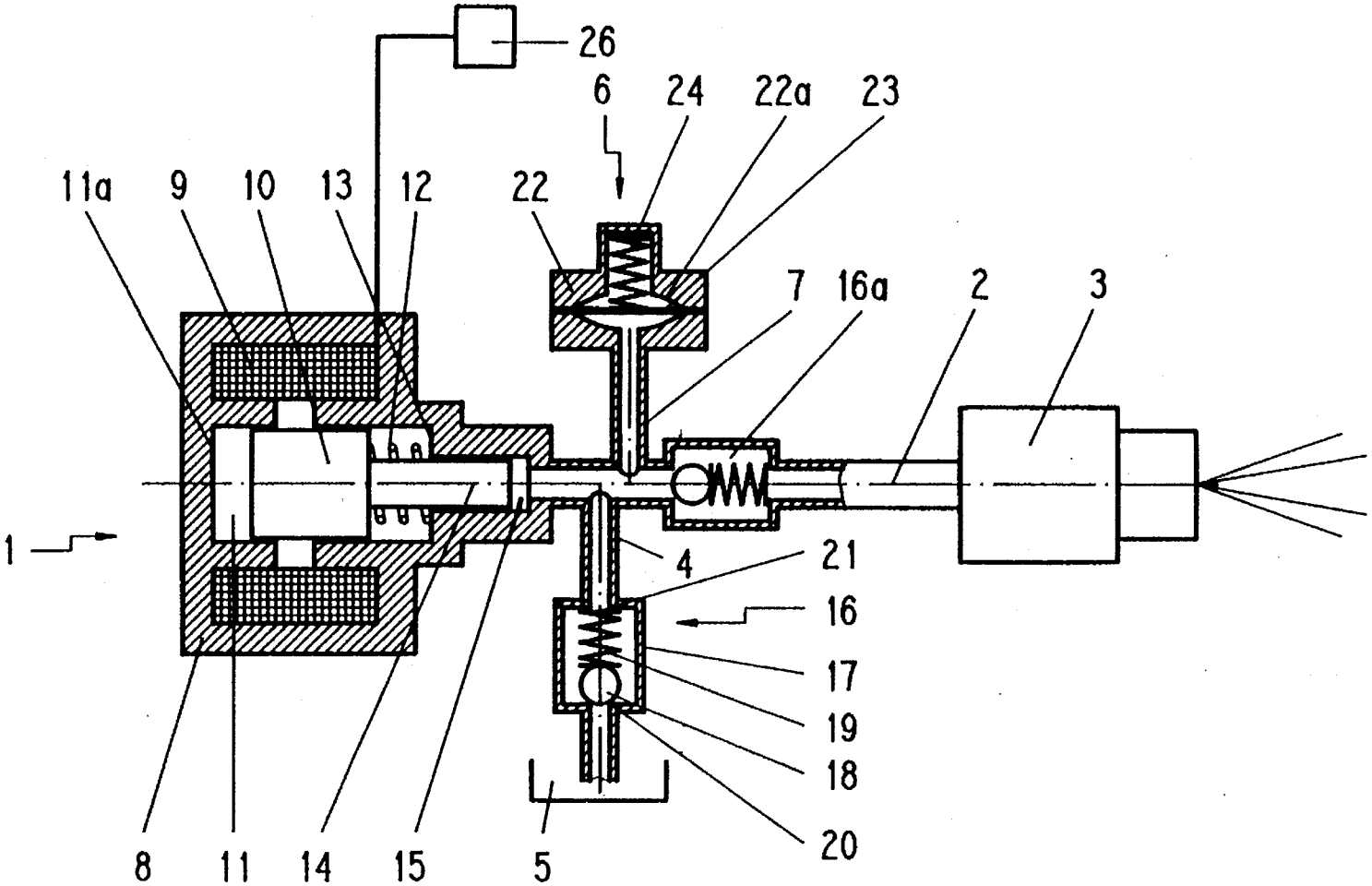

Fig. 7
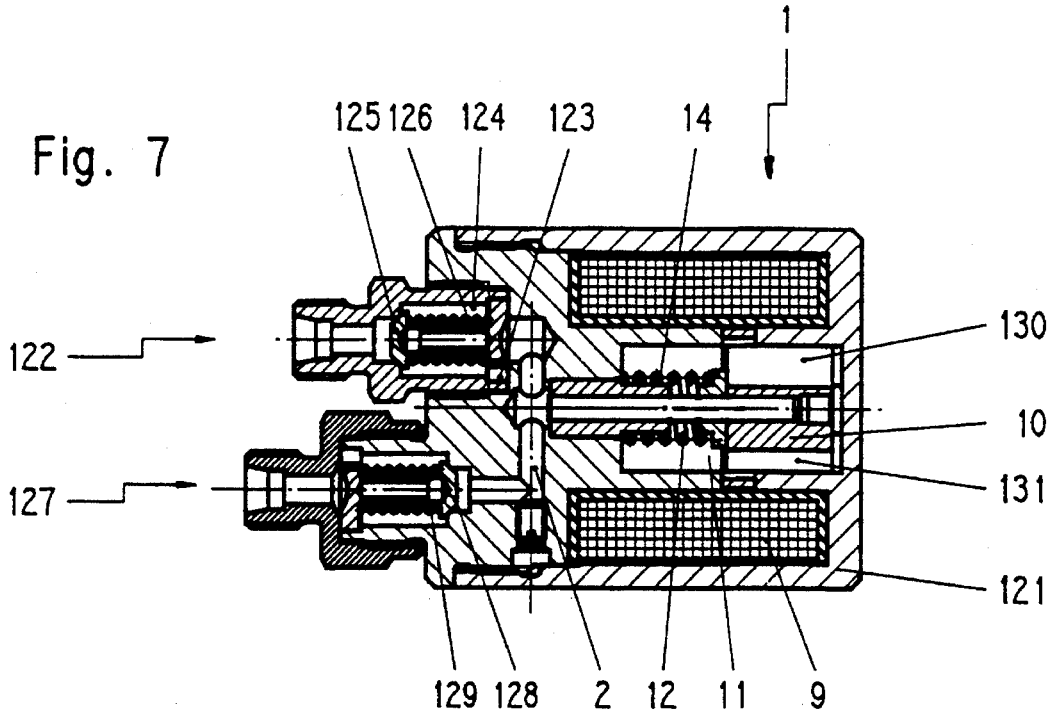
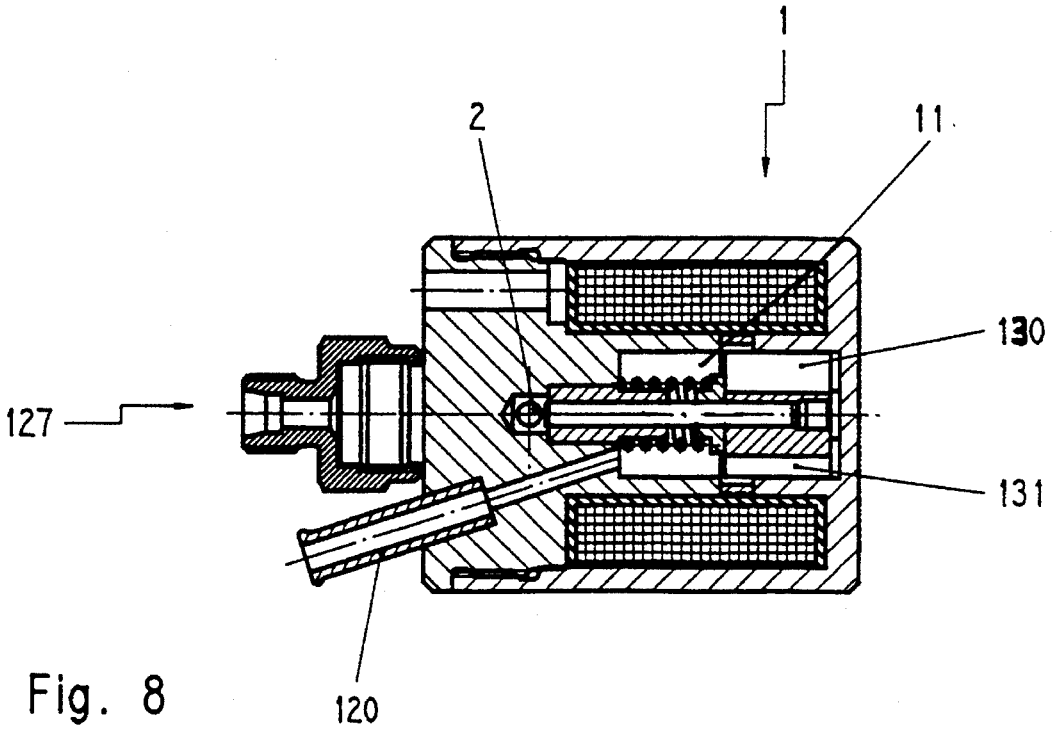
Fig. 8

FUEL INJECTION DEVICE ACCORDING TO THE SOLID-STATE ENERGY STORAGE PRINCIPLE FOR INTERNAL COMBUSTION ENGINES

The invention pertains to a fuel injection device for internal combustion engines according to the type disclosed in the preamble of Claim 1.

Fuel injection devices whose electrically driven reciprocating pumps work according to the so-called solid-state energy storage principle, have a delivery plunger or cylinder which on a specific path is accelerated virtually without resistance, whereby usually fuel is moved before the build-up of the delivery pressure required for the ejection of the fuel through the injection nozzle. In this way, before the pressure build-up necessary for the actual injection, kinetic energy is absorbed or stored which is then abruptly converted into a pressure rise in the fuel.

With a so-called pump-nozzle element operating on the solid-state energy storage principle known from DD-PS 120 514, the fuel delivery space accommodating the delivery plunger of the injection pump has in a first section axially parallel arranged grooves in the inner wall through which the fuel can flow off to the rear of the delivery plunger when the delivery plunger begins to move without a significant pressure build-up in the fuel. The adjacent second section of the fuel delivery space is the actual pressure chamber which does not have grooves. When the accelerated delivery plunger enters this pressure chamber, it is abruptly slowed down by the incompressible fuel, so that the stored kinetic energy is converted into a pressure impulse which overcomes the resistance of the injection nozzle so that fuel is injected. An attendant disadvantage is that when the delivery plunger enters the second section of the delivery space, unfavorable gap conditions viz. a relatively large gap width and a relatively small gap length produce noticeably high pressure losses which particularly reduce the possible speed and pressure level of the pressure buildup and so exert an unfavorable influence on the ejection. The pressure losses are caused by flowing off of fuel from the pressure chamber into the pressure antechamber (first section of the fuel delivery space).

According to DD-PS 213 472 this advantage should be avoided if in the pressure chamber of the delivery plunger an impact body is arranged on which the plunger, accelerated almost without resistance, impacts, so that the pressure loss during the pressure build-up can be kept acceptably small by a relatively large gap length despite a relatively large gap width (large manufacturing tolerances) between the impact body and the inner wall of the pressure chamber. This has, however, the disadvantage that the impact leads to considerable wear of the impacting elements. Moreover, the impact sets up longitudinal oscillations in the impact body and these oscillations are transferred to the fuel and in the form of high-frequency pressure oscillations disturb the injection process.

A special disadvantage of these known solid-state energy storage injection devices is that the injection process can only be controlled to a very limited extent and can therefore only be adapted to the load conditions of the engine to DE-OS 23 07 435, where the reciprocating pump has for moving pump element a sleeve-like pump cylinder which slides endwise on a pump piston in fixed position in the pump housing and defines the pump pressure chamber which is connected to the injection device via a longitudinal bore in the pump piston. A cross bore in the pump cylinder allows the flowing off of fuel to the rear of the cylinder during energy storage. The passage of the piston front edge across the bore results in the pressure build-up and so to the ejection of fuel. Here too, clearance losses are high during pressure build-up.

The object of the invention is the creation of a cheap, simple to manufacture device for fuel injection of the type described above, which makes possible the injection of fuel without noticeable pressure losses during pressure build-up, free from wear, precisely metered according to load and especially suitable for high-speed combustion engines.

This object is achieved by the characteristic features as per Claim 1. Advantageous further developments of the invention are described in the subclaims.

The invention is explained in more detail with the aid of drawings. Illustrations:

FIG. 1 to 19: diagrams giving a longitudinal view of various embodiments of the injection device as per invention.

Figure 20:
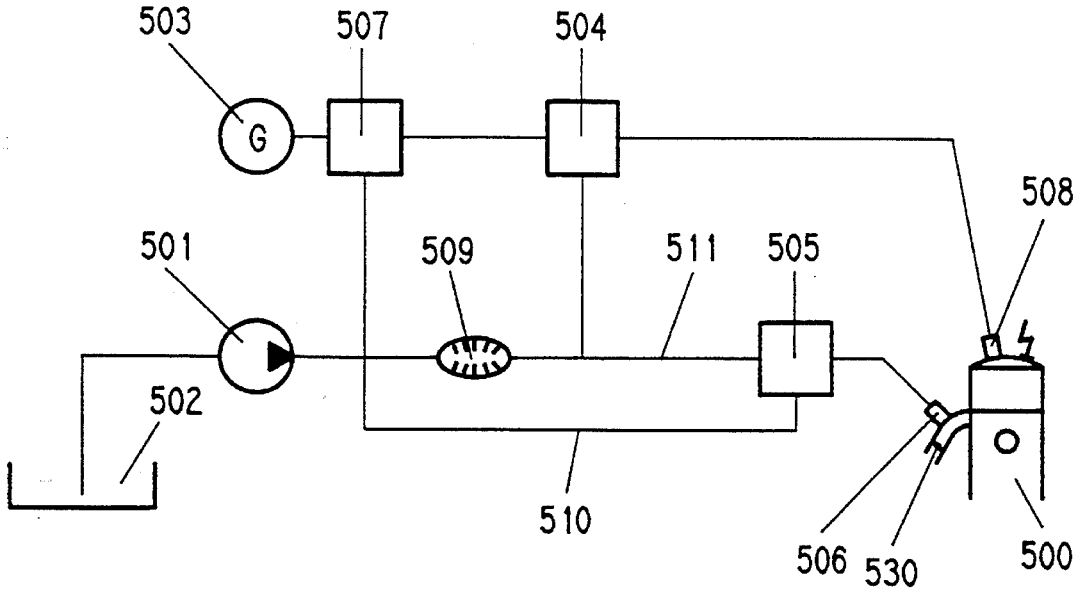
Figure 21:
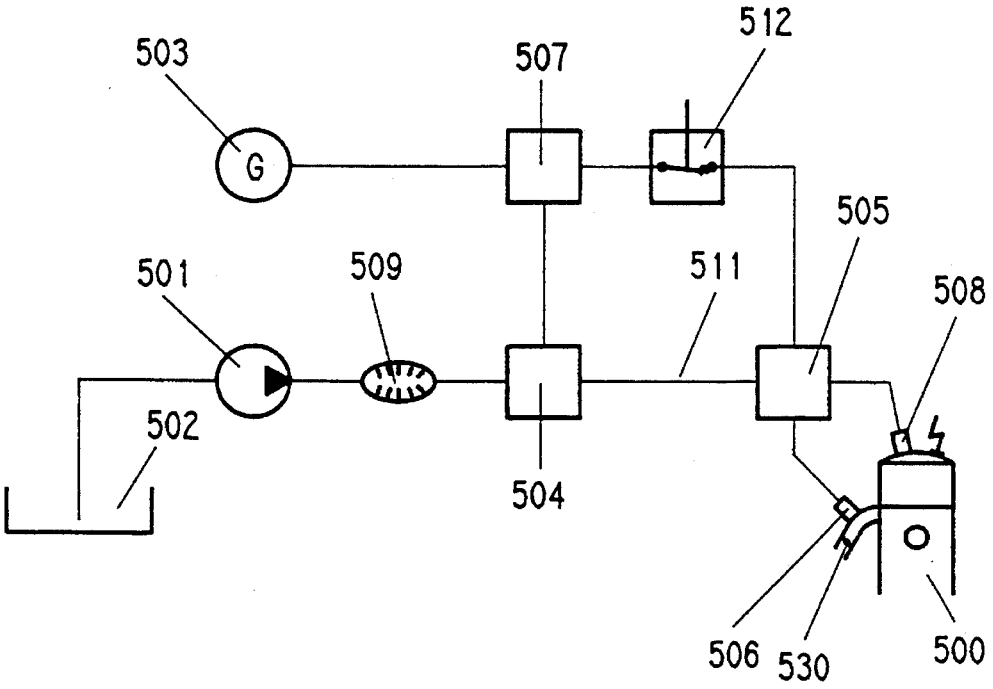
Figure 22:
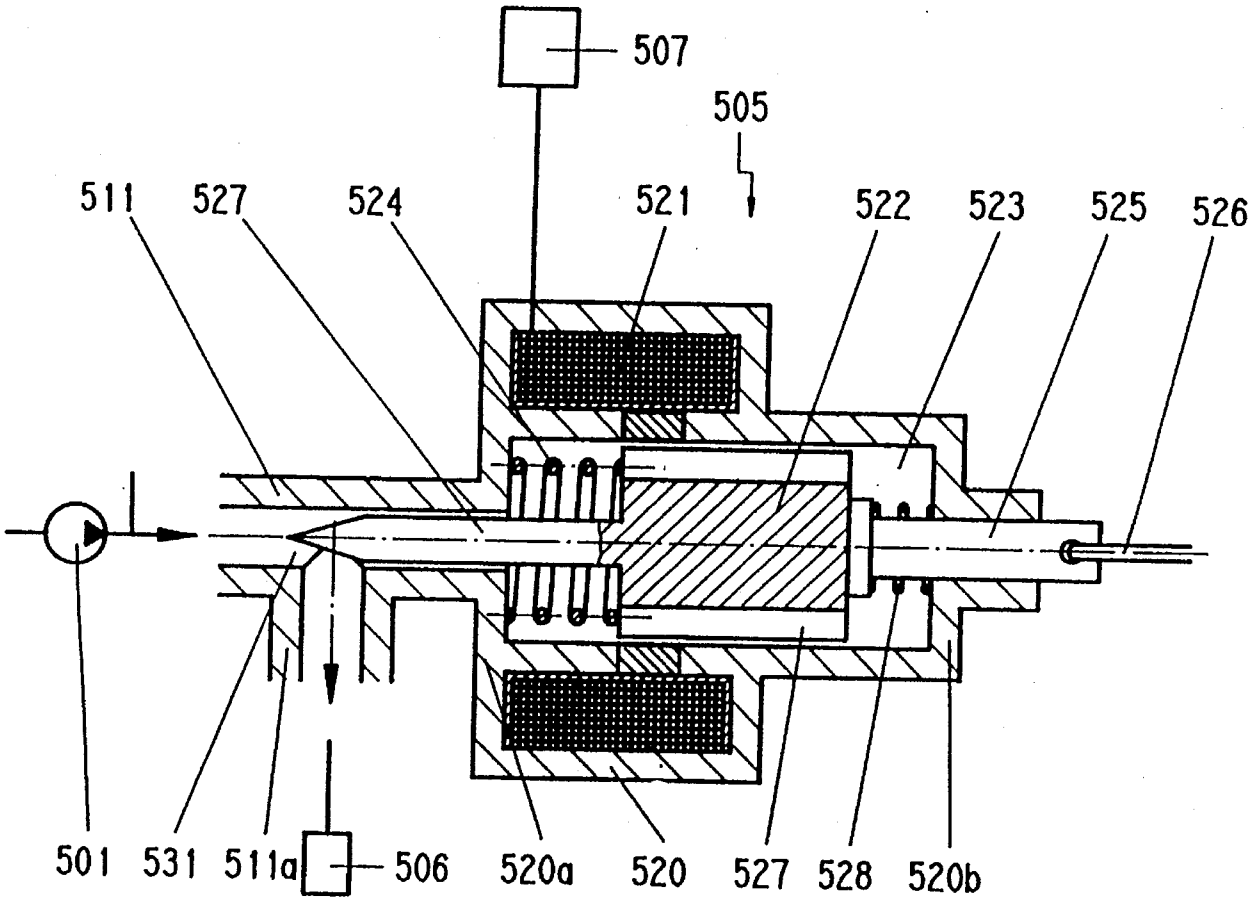

FIG. 20, 21 and 22: diagrams of a fuel supply device supporting the injection device as per invention for engine starting and emergency running without a battery.

Figure 23:
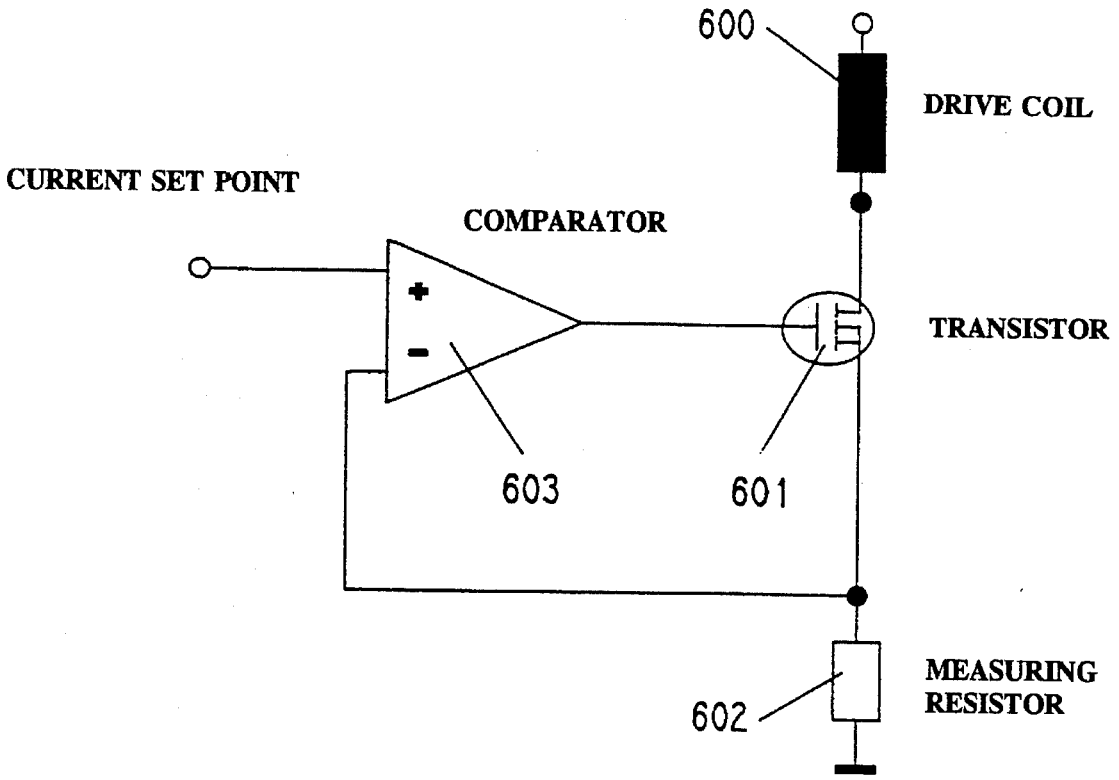

FIG. 23: diagram of a preferred circuit for triggering the coil of the injection device as per invention.

Figure 24:
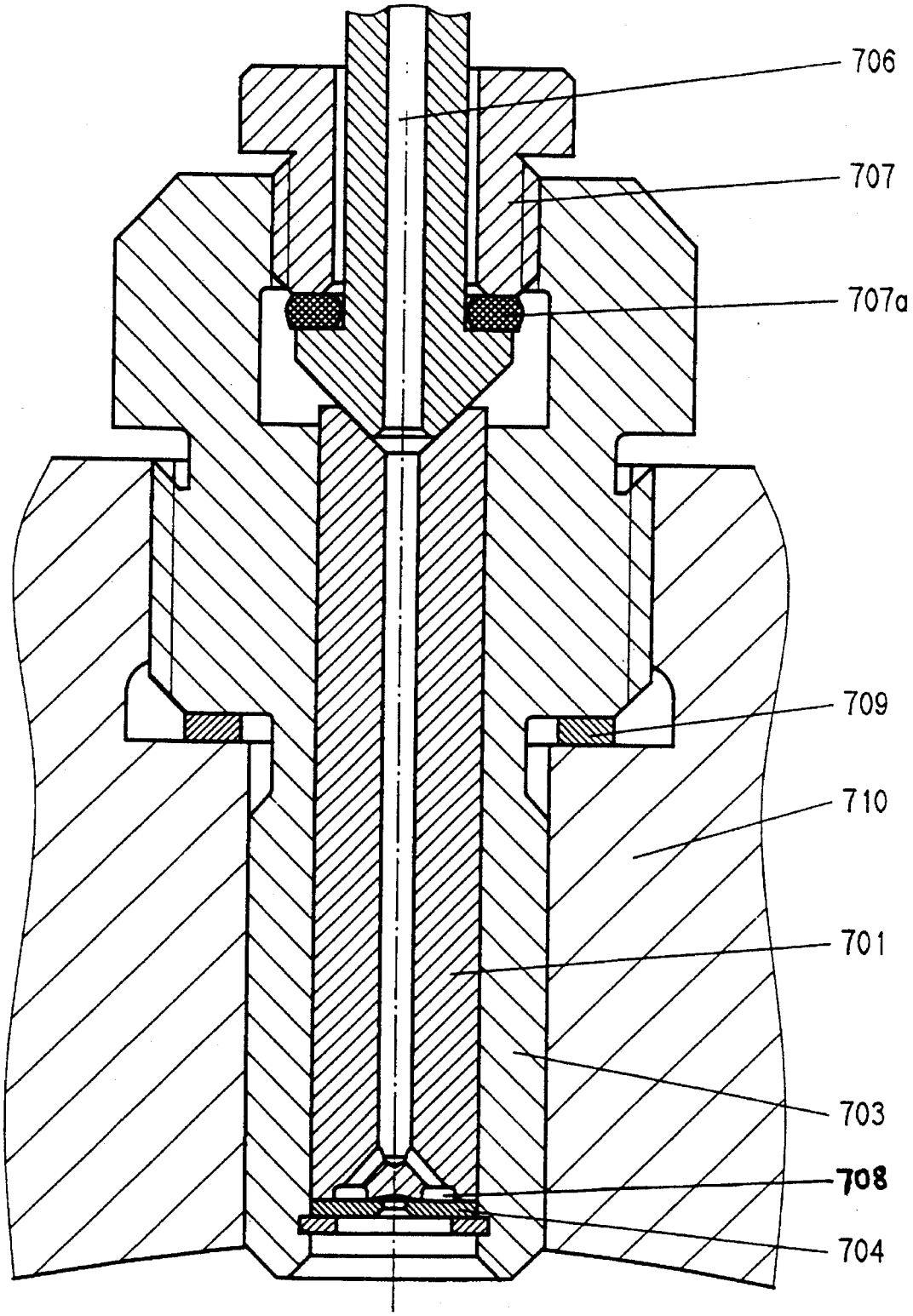
Figure 25:
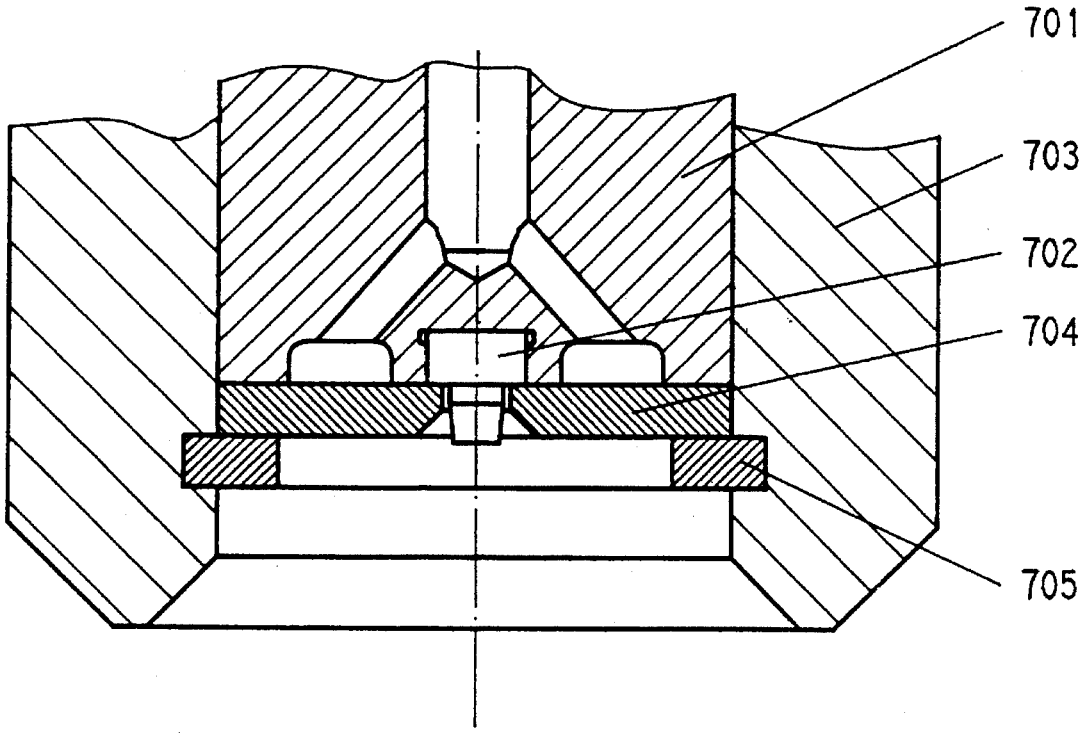
Figure 26:
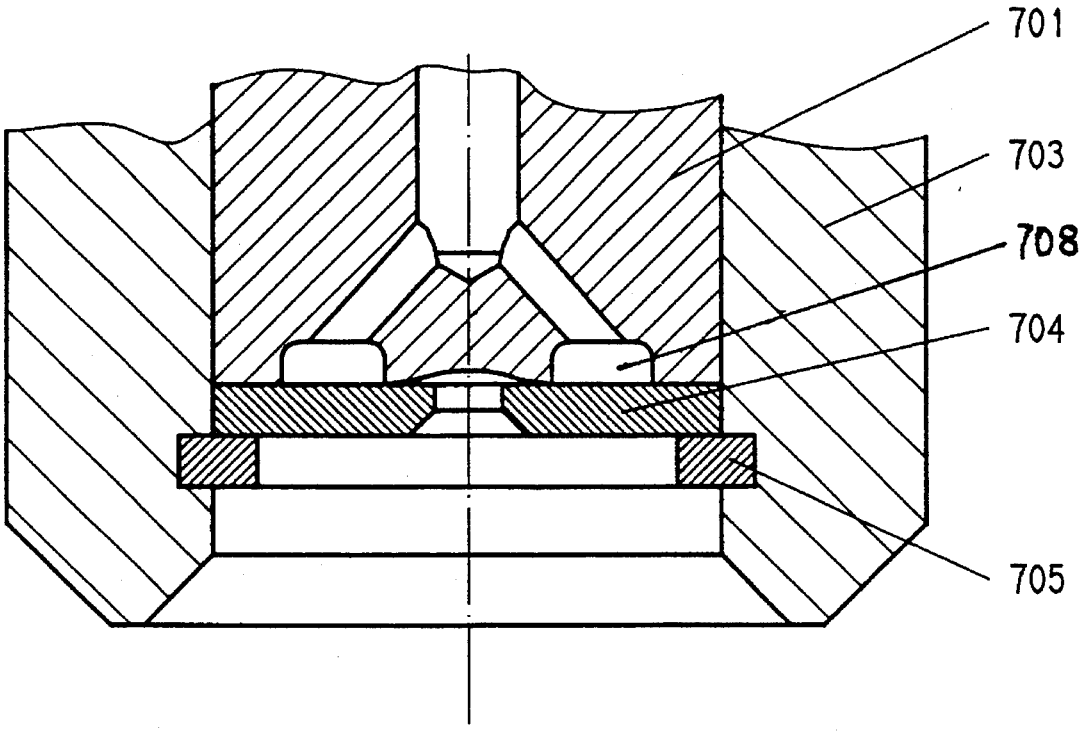
Figure 27:
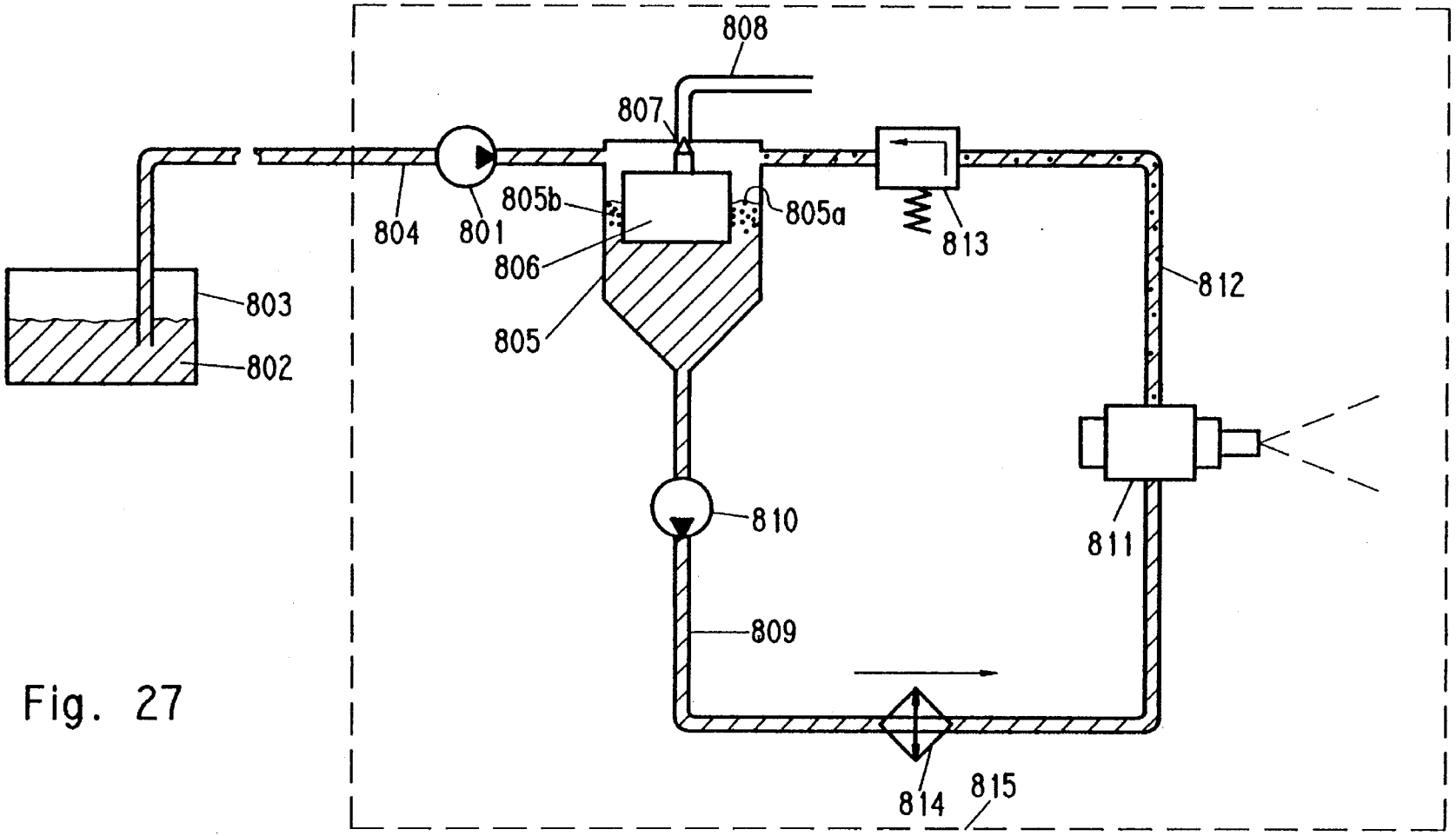

FIG. 24, 25 and 26: diagrams giving a longitudinal view of preferred embodiments of the injection valve of the injection device as per invention, and FIG. 27: diagram of a fuel supply device without a return line to the tank.

The invention provides for an initial stroke section of the delivery element of the injection pump during which the displacement of the fuel does not result in pressure build-up, whereby the stroke section of the delivery element serving for energy storage is advantageously determined by a storage volume, e.g. in the form of an empty space, and a stopping element, which as explained more fully when discussing the embodiments, may be designed differently, e.g. in the form of a spring-loaded diaphragm or a spring-loaded plunger element, to which fuel is delivered and which on a stroke distance "X" of the delivery element allow the displacement of fuel. Only when the spring-loaded element bumps against a fixed stop for instance, an abrupt pressure build-up is produced in the fuel so that a displacement of the fuel towards the injection nozzle is effected. The injection device as per FIG. 1 has an electromagnetic reciprocating pump 1 which is connected via a delivery line 2 to an injection device 3. From the delivery line 2 a suction line 4 branches off which is connected to a fuel tank 5. A volume storage element 6 is also connected via a line 7 to the delivery line 2 near the connection of the suction line 4.

The pump 1 is a reciprocating pump and has a housing 8 accommodating a magnet coil 9, and arranged near the coil passage, a rotor 10 in the form of a cylindrical body, e.g. a solid body, which is supported in a housing bore 11 near the central longitudinal axis of the toroid coil 9 and is pressed by a pressure spring 12 into a starting position where it rests against the bottom 11 a of the housing bore 11. The pressure spring 12 is braced against the front face of the rotor 10 on the injector side and an annular step 13 of the housing bore 11 opposite this front face. The spring 12 encircles with clearance a delivery plunger 14 connected rigidly, e.g. in one piece, to the rotor face on which the spring 12 acts. The delivery plunger 14 penetrates a relatively long way into a cylindrical fuel delivery space 15 formed coaxially as an axial extension of the housing bore 11 in the pump housing 8 and is in transfer connection with the pressure line 2. Because of the depth of penetration, pressure losses during the abrupt pressure rise are avoided, whereby the manufacturing tolerances between plunger 14 and cylinder 15 may even be relatively large, need e.g. only be of the order of a hundredth of a millimeter, so that manufacturing effort is kept minimal.

The suction line 4 has a non-return valve 16. The housing 17 of the valve 16 may have for valve element a ball 18 which in its resting position is pressed against its valve seat 20 at the tank-side end of the valve housing 17 by a spring 19. For this purpose the spring 19 is braced on one side against the ball 18 and on the other against the wall of the housing 17 opposite the valve seat 20 near the opening 21 of the suction line 4.

The storage element 6 has a housing 22 e.g. consisting of two parts in whose cavity a diaphragm 23 when stressed functions as the element to be displaced and which separates from the cavity a pressure-side space filled with fuel and when unstressed divides the cavity into two halves mutually sealed off by the diaphragm. On the side of the diaphragm 23 away from the line 7 a spring force acting on an empty space, the storage volume, e.g. a spring 24, which serves as return spring for the diaphragm 23. The end of the spring 24 opposite the diaphragm is supported on an inner wall of the cylindrically widened empty cavity. The empty cavity of the housing 22 is bounded by a domed wall forming a stop face 22*a* for the diaphragm 23.

The coil 9 of the pump 1 is connected to a control device 26 serving as electronic control for the injection device.

In the de-energized state of the coil 9, the rotor 10 of the pump 1 is on the bottom 11 a through the initial tension of the spring 12. The fuel supply valve 16 is closed and the storage diaphragm 23 is held in its position away from the stop face 22*a* in the housing cavity by the spring 24.

When the coil 9 is triggered by the control device 26, the rotor 10 with plunger 14 is moved against the force of the spring 12 towards the injection valve 3. Thereby the delivery plunger 14 connected to the rotor 10 displaces fuel from the delivery cylinder 15 into the space of the storage element 6. The spring forces of the springs 12, 24 are relatively weak, so that the fuel displaced by the delivery plunger 14 during the first stroke section of the delivery plunger 14 presses the storage diaphragm 23 almost without resistance into the, empty space. The rotor 10 can then first be accelerated almost without resistance until the storage volume and the empty space of the storage element 6 are exhausted by the impact of the diaphragm 23 on the domed wall 22*a*. The displacement of the fuel then suddenly ceases and the fuel is compressed abruptly because of the already high kinetic energy of the delivery plunger 14. The kinetic energy of the rotor 10 with delivery plunger 14 acts on the liquid. This produces a pressure impulse which travels through the pressure line 2 to the nozzle 3 and leads to ejection of the fuel.

For the end of the delivery the coil 9 is de-energized. The rotor 10 is returned to the bottom 11*a* by the spring 12. Thereby the liquid stored in the storage device 6 is sucked back via the lines 7 and 2 into the delivery cylinder 15 and the diaphragm 23 is pressed back into its initial position by the spring 24. Simultaneously, the fuel supply valve 16 opens so that additional fuel is sucked from the tank 5.

Advantageously, in the pressure line 2 between the injection valve 3 and the branch lines 4, 7 a valve 16*a* has been arranged which maintains a static pressure in the space on the side of the injection valve, whereby this pressure is e.g. higher than the vapor pressure of the liquid at maximum operating temperature, so that the formation of bubbles is prevented. The static pressure valve may be designed like e.g. the valve 16.

Figure 2:
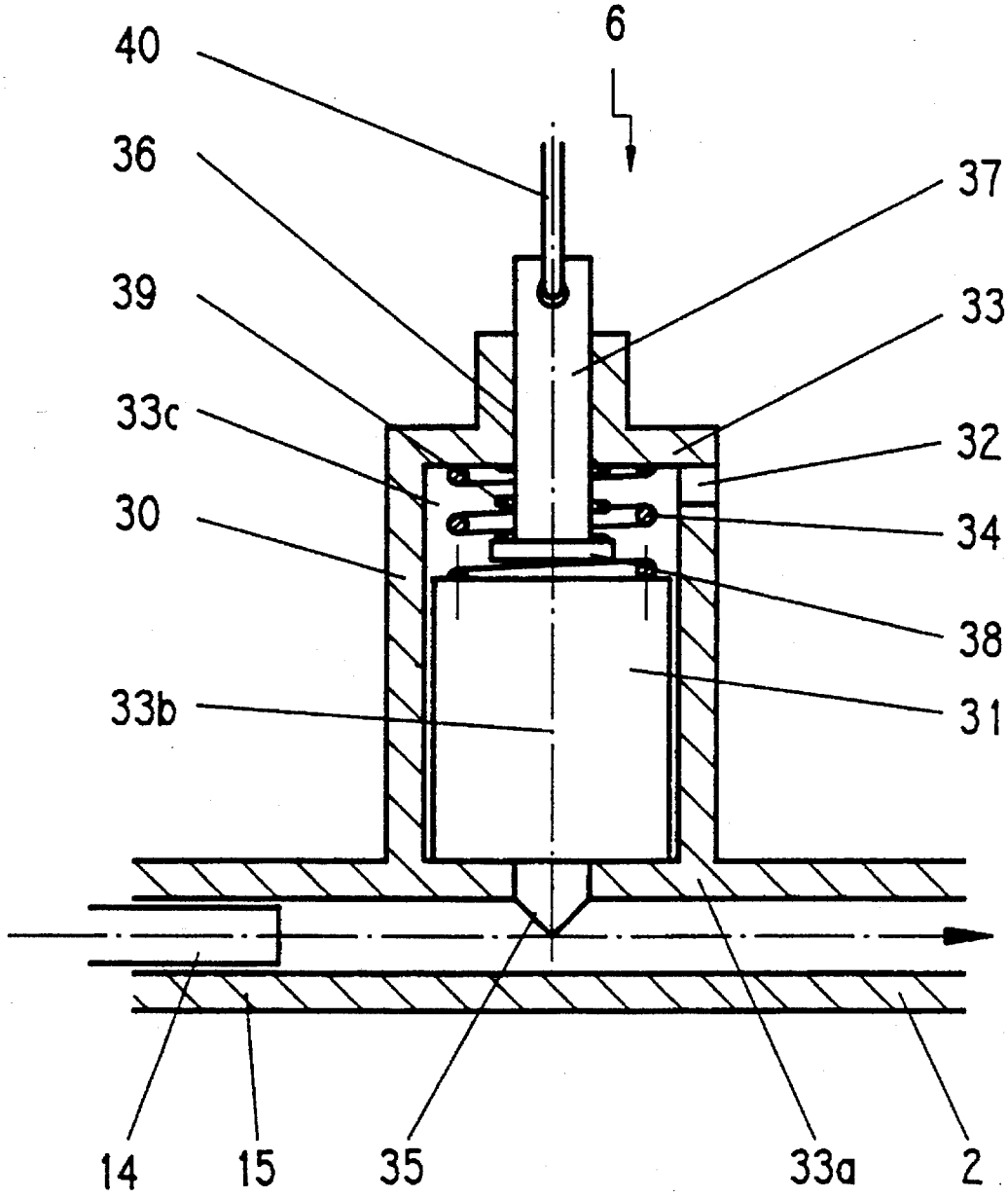

It is possible to use a storage piston 31 instead of the diaphragm 23 for the storage element 6. The stop which then suddenly terminates the storage can as per invention be designed adjustable so that the path length of the acceleration stroke of rotor 10 and delivery plunger 14 can be varied. For this adjustment it is preferable to use a cable pull e.g. linked to the throttle valve of the engine. Alternatively, the adjustment can be controlled advantageously by the control device 26, e.g. by means of an operating magnet. FIG. 2 shows an embodiment of the storage element 6 with a displacement piston 31 adjustable through a cable pull 40.

The storage element 6 as per FIG. 2 has a cylindrical housing 30 which may be constructed integral with the pressure line 2. The displacement element is a storage piston 31 which fits snugly against the inner wall of the cylinder housing 30 so that no significant leakage can occur, whereby an empty space 33*c* is provided in the cylinder 30 into which the piston 31 can be displaced. Any leaked liquid can flow out of the empty space 33*c* through a discharge bore 32 and is carried to the fuel tank 5 (see FIG. 1 ). The discharge bore 32 is constructed in the cylinder wall of the housing 30 opposite the housing wall 33*a* near the housing cover 33, housing wall 33*a* being integrally formed with a wall section of the pressure line 2. The discharge bore 32 is possibly oriented radially to the central longitudinal axis 33*b* of the cylindrical housing 30.

Between the inside of the housing cover 33 and the front face of the piston 31 opposite this wall a pressure spring 34 is mounted which presses the piston 31 in its resting position against the opposite housing end wall 33*a* which features a bore 35 along the central longitudinal axis 33*b* of the housing 30 and comes out in the line 2.

The housing cover 33 of the housing 30 has a tubular axial extension and in the passage of the extension pipe 36 there is a stop pin 37 in a piston-like sliding arrangement, this pin has a ring 38 at its end in the space 33*c*. The piston 31 bumps against the bottom of the ring 38 when it is moved from its resting position towards the housing cover 33. This stop device 37 is mounted pretensioned by a spring 39. For this purpose the spring 39 is braced on one side against the inside of the cover 33 and on the other against the annular step of the ring 38 of the pin 37. To the part of the pin 37 arranged outside the cylinder 30 a cable pull is attached which is e.g. connected to the throttle valve of the engine. Via the cable pull 40 the stop pin 37 is adjustable in the direction of the central longitudinal axis 33*b* of the housing 30 so that the possible stroke distance of the piston 31 can also be varied in accordance with the position of the check ring 38 The stop pin 37 can be adjusted according to the required acceleration stroke of the rotor 10 of the pump 1 (FIG. 1). The operation of the storage element 6 as per FIG. 2 is basically the same as that of the storage element 6 as per FIG. 1. During a first stroke section of the delivery plunger 14 and the rotor 10 (FIG. 1) the storage piston 31 of the storage element 6 is pushed out of its resting position (FIG. 2) by displaced fuel whereby the return spring 34 is set relatively weak so that the fuel moved by the delivery plunger 14 attached to the rotor 10 can be displaced almost without resistance of the storage piston 31. Consequently the rotor 10 with delivery plunger 14 is accelerated on a part of the stroke almost without resistance i.e. essentially only against the spring force of the springs 12, 34 until the storage piston 31 bumps with its spring-tensioned front face against the check ring 38 so that the fuel in the delivery cylinder 15 and the pressure line 2 is compressed abruptly due to the high kinetic energy of the rotor 10 and delivery plunger 14 and this kinetic energy is transferred to the fuel. The resultant pressure impulse then leads to the ejection of fuel through the nozzle 3.

The adjustable stop pin 37 is also suitable for the exclusive control of the fuel quantity to be injected for specific engines.

Figure 3:
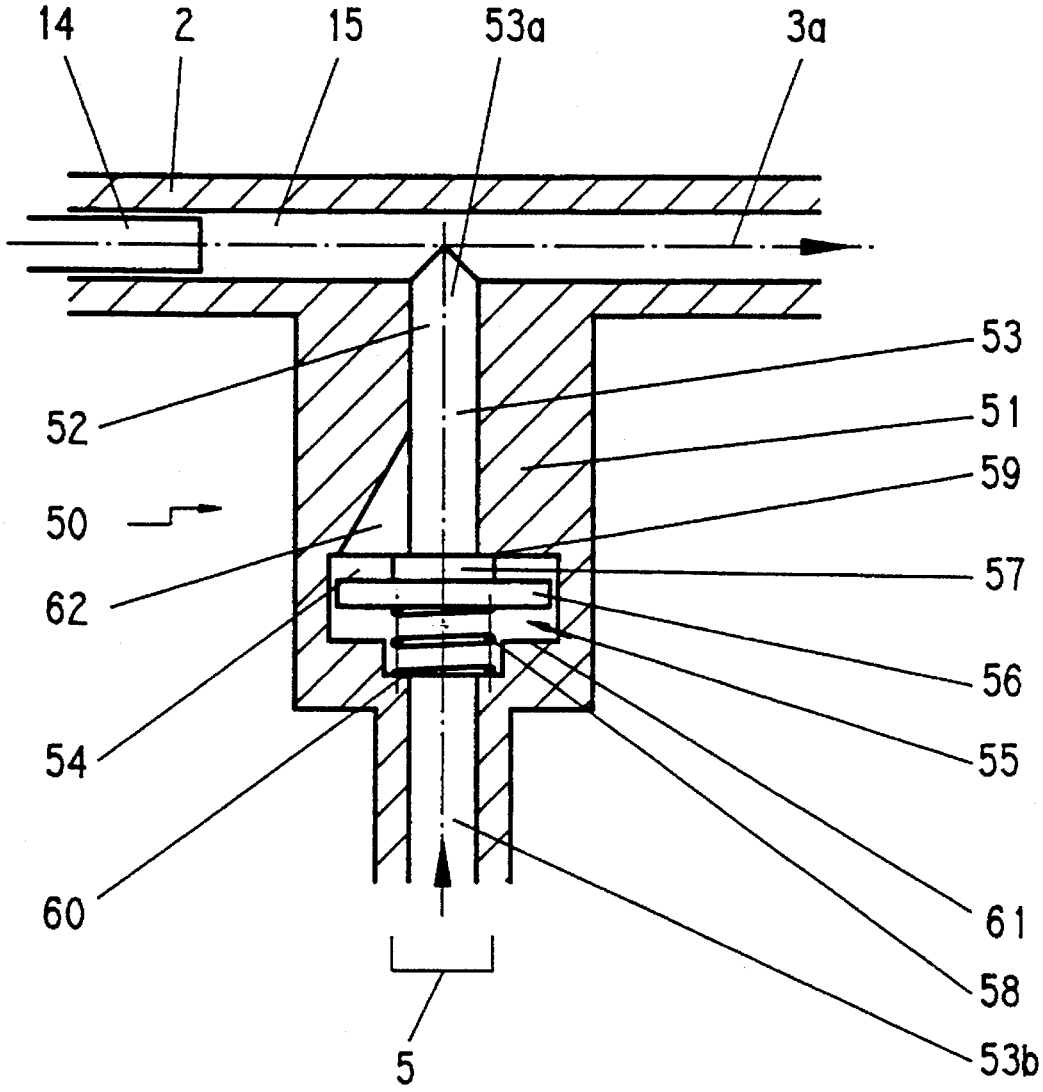

According to a further advantageous embodiment of the invention it is proposed to design the fuel supply valve (valve 16 in FIG. 1) so that it functions additionally as a storage element (similar to storage element 6 in FIG. 1 and 2), so that during the first stroke section of the delivery plunger, fuel is drawn almost without resistance from the delivery cylinder 15 and the pressure line 2 into a storage volume whereby this storage element also determines the length of travel of the first stroke section of the delivery plunger 14. FIG. 3 shows a first embodiment of a fuel supply valve of this design which also ensures the function of a storage element for the determination of the first stroke section of the delivery plunger. An advantage of this space-saving variant of the invention is that instead of two components as per FIG. 1 and 2, viz. a fuel supply valve and a separate storage element, there is only one component.

The valve 50 comprises a basically cylindrical housing 51 which in the embodiment shown forms one piece with the pressure line 2. The housing 51 features a through-bore 52 which on the pressure-side has a section 53 exiting into the pressure line 2 via an opening **53*a* and on the inlet side has a section 53*b* connected to the supply line to the fuel tank 5 (FIG. 1). Between the two coaxial bores 53 and 53*b* in the housing 51 is a radially widened valve chamber 54 which accommodates a shut-off valve 55. The valve element 55 consists of a circular disc 56 of large diameter and a circular disc 57 of small diameter whereby both circular discs are made in one piece and whereby the circular disc 57 with the smaller diameter is arranged on the side of the bore section 53. A valve body return spring 58 pushes the valve element 55 in resting position against the annular front face 59 of the valve chamber 54, whereby the spring 58 is braced on one side against the disc 56 of the valve element 55 and on the other against the bottom of an annular step 60 which is arranged centrally in the front face 61 opposite the front face 59 of the valve chamber 54. The disc 56 can therefore come to rest against and seal the front face 61 of the valve chamber 54**.

The bore section 53 of the central longitudinal bore 52 is connected with the valve chamber 54 via grooves or slots 62 arranged in the housing wall 51 which may widen funnel-like towards the valve chamber 54 (see FIG. 3).

In the initial position shown in FIG. 3 the valve element 55 rests with the disc 57 against the front face 59 of the valve chamber 54 through the action of the spring 58. In this position the bore section **53*b* on the tank side is in flow connection with the pressure line 2 and the delivery cylinder 15 via the valve chamber 54 and the grooves 62 as well as the bore section 53, whereby the symbolically presented fuel tank 5 makes available an empty space or storage volume into which fuel can be displaced. If the delivery plunger 14 is accelerated towards the injection nozzle (arrow 3*a*) as a result of excitation of the coil, the displaced fuel can flow almost without resistance through the bore section 53, the grooves or slots 62, the valve chamber 54 and the supply bore 53*b* into the tank. The flow conditions of the valve 50 have been so designed that upon reaching a specific flow rate, of the fuel, the flow forces at the valve element 55 as it is being flooded with fuel become greater than the pre-tensioning force of the spring 58 so that the element is pushed towards the bore 53*b*. Thereby the valve element 55 shuts off with the disc 56 the supply cross section of the bore 53*b* or the recess of the annular step 60 resulting in an abrupt transfer of the kinetic energy of the rotor 10 with plunger 14 to the fuel in the delivery cylinder 15 and in the pressure line 2 so that fuel is ejected through the nozzle 3 (see FIG. 1). With this version of valve device 50 the energy storage path of the rotor 10 with plunger 14 can be controlled by the excitation of the coil. The valve element 55 lifts again from the opening of the supply line 53*b* through the pressure of the spring 58 when the plunger 14 and the rotor 10 return so that additional fuel can be sucked from the tank 5**.

Figure 4:
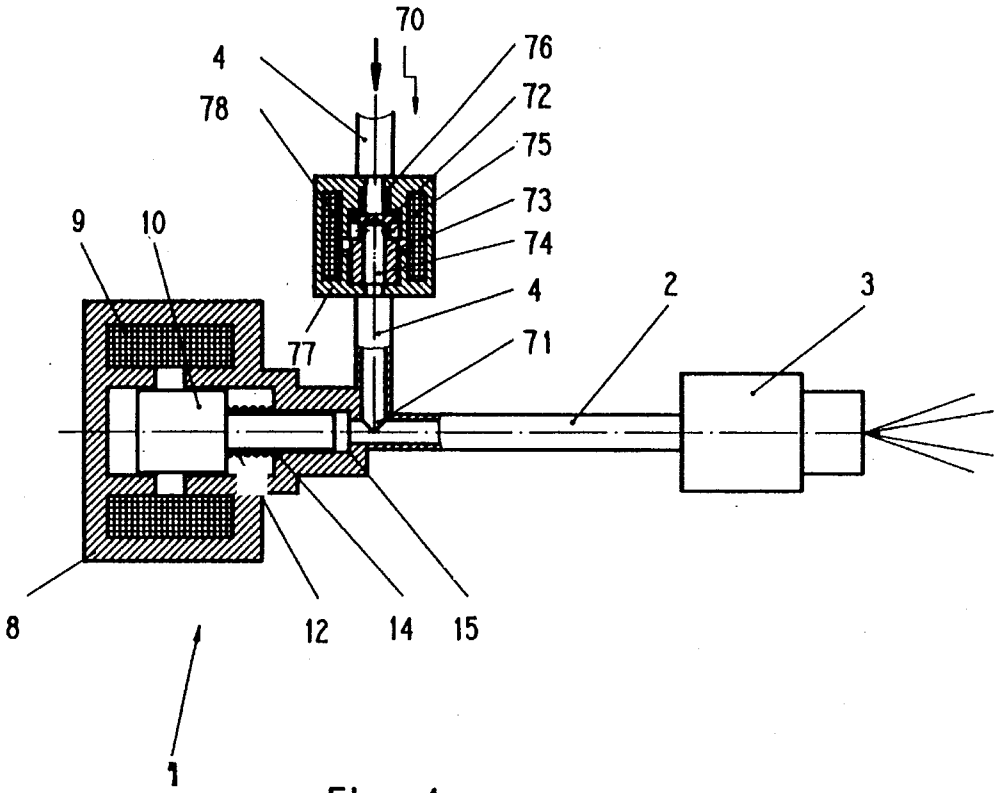

FIG. 4 shows a variant of the component described above on the basis of FIG. 3, whereby this component performs both the function of the fuel supply and the control of the fuel ejection, whereby additionally the stroke section of the delivery plunger serving for the energy storage can also be controlled through the component. An electrically controlled valve 70 is used for this purpose.

At the beginning of the pressure line 2 in the immediate vicinity of the pressure or delivery chamber 15 of the pump 1 the pressure line 2 has an opening 71, connected to the fuel supply line 4, where the electrically controlled valve is inserted. The valve 70 has in a valve housing 77 a spring-loaded valve plate 72 rigidly connected to a rotor 73. The rotor 73 has a central axial bore 74 and at least one cross-bore 75 near the valve plate 72. In the resting position the valve 70 is open through the rotor 73 being pushed into a final position on the side of the pressure line by a spring 76 acting on the plate 72, whereby in this final position the fuel in the tank (not shown)is connected with the fuel of the pressure chambers 15, 2 through the bores 75 and 74 and the pressure line opening 71.

The housing 77 also accommodates a coil 78 which surrounds the rotor 73 with clearance.

The injection process as per invention proceeds as follows. With the pressure line 2 completely filled, the magnetic coil 9 of the pump 1 is excited so that the rotor-delivery plunger element 10, 14 of the pump 1 is accelerated from its resting position. The fuel displaced by the plunger 14 flows off through the pressure line opening 71, the central bore 74, the cross-bore 75 around the valve plate 72 and into the section of the line 4 on the tank side to the fuel tank. At a given moment the valve 70 is activated by the coil 78 being excited and the rotor 73 moved until the valve plate 72 sits on its valve seat and blocks the fuel flow. The pressure line opening 71 is blocked abruptly or very fast so that no further fuel can escape through the line 4. Rotor 10 with delivery plunger 14 is consequently decelerated abruptly and transfer the stored kinetic energy to the incompressible fuel which produces a pressure impulse so that the fuel from the pressure line 2 is ejected through the injection nozzle 3, whereby as with the other embodiments of the invention, the rotor 10 with plunger 14 has either reached its full delivery stroke or is displaced further. The injection nozzle 3 is of an already known hydraulically controlled and spring-loaded design. The triggering of the valve 70 preferably takes place through control electronics actuating both the pump 1 and the shut-off valve 70.

Figure 5:
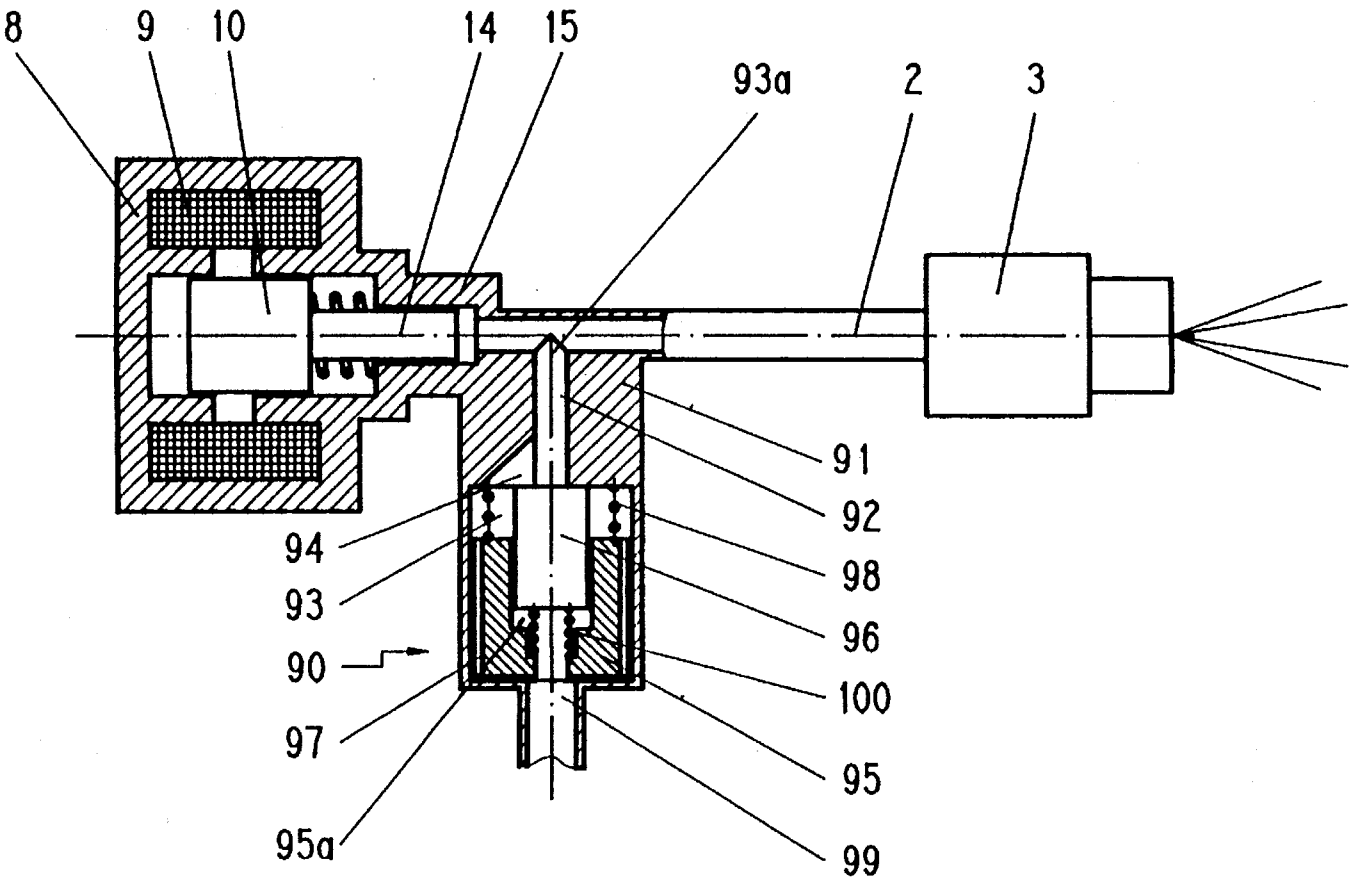

FIG. 5 shows a variation of the valve as per FIG. 3. The integral storage clement-supply valve 90 has a housing 91 constructed as a single unit with the housing 8 of pump 1 and the pressure line 2. The housing 91 has a central longitudinal bore 92 which on one side comes out into the pressure line 2 via an opening **93*a* and on the other into a cylindrical valve chamber 93 whereby additionally grooves 94 similar to the grooves 62 as per FIG. 3 lead from the bore 92 to the valve chamber 93. The valve element consists of two parts and comprises a cylinder 95 included in the valve chamber 93, this cylinder having in its cylindrical, central, stepped through-bore a slidable piston 96. The outside surface of the cylinder 95 has axial, parallel slots 97. The cylinder 95 is held by a spring 98 in its resting position where it sits with its one front face on the tankside bottom of the valve chamber 93 into which exits a fuel supply line 99 from the tank. The bore accommodating the piston 96 has on the tank side a spring 100 holding the piston 96 against the pressure-side bottom of the valve chamber 93, so that the bore 92 is covered, whereby in the tank-side inner space of the cylinder 95 a free space 95***a* is formed for the piston 96.

The valve 90 functions as follows. When the delivery plunger 14 executes a suction stroke, fuel is sucked from the line 99 due to the fact that the cylinder 95 is lifted from the tank-side bottom of the valve chamber 93 through the underpressure against the pressure of the spring 98, so that fuel can flow into the pressure line 2 via the longitudinal slots 97, the valve chamber 93 and the slot 94 as well as the bore 92. During this process the piston 96, as shown in FIG. 5, rests against the pressure-side bottom of the valve chamber 93. At the end of the suction stroke the cylinder 95 is pushed by the spring 98 into the position as per FIG. 5 in which the cylinder 95 again rests against and seals the bottom of the valve chamber 93.

At the beginning of the delivery stroke of the delivery plunger 14, the piston 96 in the cylinder 95, because of the relatively low set spring force of the spring 100, is moved out of its position against the pressure-side bottom of the valve chamber 93 and pushed into the free space 95*a* whereby into the resulting additional space in the valve chamber 93, fuel flows from the pressure chamber 15, 2, this fuel being displaced during the delivery movement of the delivery plunger 14, whereby fuel is pressed back into the tank by the piston 96 on the tank-side front face of the piston 96 via the line 99. The delivery stroke of the delivery plunger 14 is ended by the fact that the piston 96 strike, s with its tankside front face on which the spring 100 acts, the step in the central longitudinal bore of the piston 95. This abrupt ending of the basically resistanceless acceleration stroke of the rotor 10 with delivery plunger 14, produces a very steep pressure rise in the pressure line 2 so that fuel is ejected through the nozzle 3 at high pressure.

Figure 6:
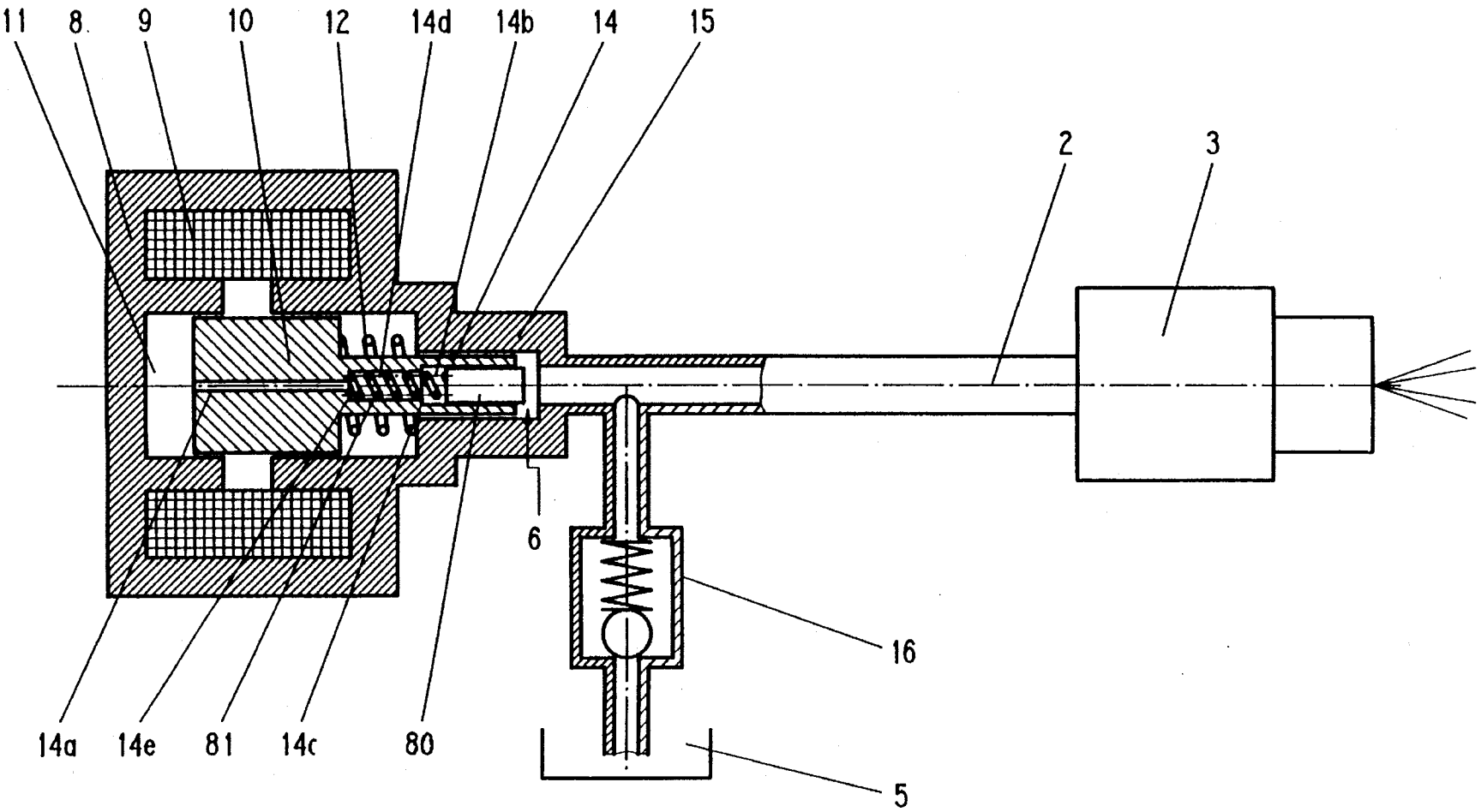

A further variant of the invention proposes to construct the storage element 6 in one unit with the delivery plunger of the reciprocating pump i. FIG. 6 shows such an embodiment. The storage element consists in a storage piston 80 which—in a first pressure-side section of a central longitudinal stepped bore 14*b* of a stepped bore 14*a* going centrally through the plunger 14 and the rotor 10—is pushed by a spring 81 against a pressure-side stop (not shown). The piston 80 in resting position thereby protrudes with one front face into the pressure chamber 15. The bore section 14*b* in the delivery plunger 14 accommodating the storage piston 80, continues after the step 14*c* to the rotor 10 in a further section of stepped bore 14*d* against whose step 14*e* is braced the pressure spring 81 pressing against the rotor-side front face of the piston 80. The bore 14*a* after step 14*e* finally also passes through the rotor 10 and comes out into the empty rotor space 11 so that air can be displaced.

The storage element of this embodiment functions as follows. On a first part of the stroke of the delivery plunger 14, the energy storage path, the storage piston 80 is pushed into the bore of the delivery plunger 14 designed for the piston, making available on the side of the pressure chamber an additional space for displaced fuel, so that during the first stroke section the rotor 10 together with the delivery plunger 14 can basically be accelerated without resistance.

The resistanceless acceleration of rotor 10 and delivery plunger 14 is ended when the rotor-side front face of the storage piston 80 comes to rest against the annular shoulder 14*c* of the stepped bore 14*a*. The result is an abrupt pressure rise so that fuel is ejected through the nozzle 3.

The variant of the injection device as per invention described in the following on the basis of FIG. 7 and 8 is of single-unit construction for the electrically driven reciprocating pump and stop device.

With the embodiment shown in FIG. 7 and 8 a hydraulic valve as well as the pump and the pressure line 2 are accommodated in a common housing 121. The function and the main construction of the pump with electromagnetic drive are basically the same as for the previously described embodiments of the pump 1 of the device as per the invention, whereby the fuel induction takes place through a valve 122 fitted into the pump housing 121 and connected with the pressure line 2 (FIG. 7).

With the embodiment shown, the valve 122 closes automatically at a specific flow rate through the operation of the Bernoulli effect. The fuel flowing through the pressure line 2 during the acceleration stroke enters the valve chamber 124 through a gap 123. Between the valve cone 125 and the matching valve seat a small annular clearance has been left which can be set through appropriate design of a spring 126 acting on the valve cone 125. Fuel flows through this annular clearance and there produces according to Bernoulli a lower static pressure than in the surroundings. At a specific flow rate the static pressure in the annular clearance drops so far that the valve cone 125 is pulled up and the valve 122 closes so that the pressure impulse required for the expulsion of the fuel through the injection nozzle is generated. The pressure line 2 leading to the injection nozzle is connected to the exit of a non-return valve 127 which is also integrated with the housing 121.

The valve cone 128 of the valve 127 is pressed against the mating valve seat by the initial tension of a spring 129, whereby the spring 129 is so designed that the valve 127 is closed when the pressure in the pressure line 2 is below the value leading to an expulsion of fuel through the injection nozzle which is directly connected to the valve 127. The non-return valve 127 also prevents the formation of bubbles in the pressure line 2 to the injection valve, because the non-return valve ensures a static pressure in the pressure line between injection nozzle and non-return valve which is higher than the vapor pressure of the fuel.

The rotor 10 in this embodiment has axially parallel slots 130 and 131 of different depth in the casing which are divided over the periphery of the essentially cylindrical rotor. These slots prevent the formation of turbulence when the solenoids 9 are excited and so contribute to energy saving. Oil leaked into the rotor space 11 can be sucked off with a line 120 leading from the rotor space 11 through the housing 121 to the outside.

The resetting of the rotor of the injection pump is usually effected by means of the return spring fitted for this purpose. To reach high injection frequencies, the reset time of the rotor must be kept small. This can be realized e.g. by a correspondingly high spring force of the return spring. However, as the reset time becomes smaller, the impact speed of the rotor against the rotor stop increases. A disadvantage of this can be the resulting wear and/or the rebounding of the rotor at the rotor stop, so that the duration of the whole operating cycle is increased. One of the objects of the invention therefore is to keep the fall time of the rotor until resting position small. The invention proposes to meet this object by e.g. a hydraulic damping of the rotor return movement in the last part of this movement.

Figure 9:
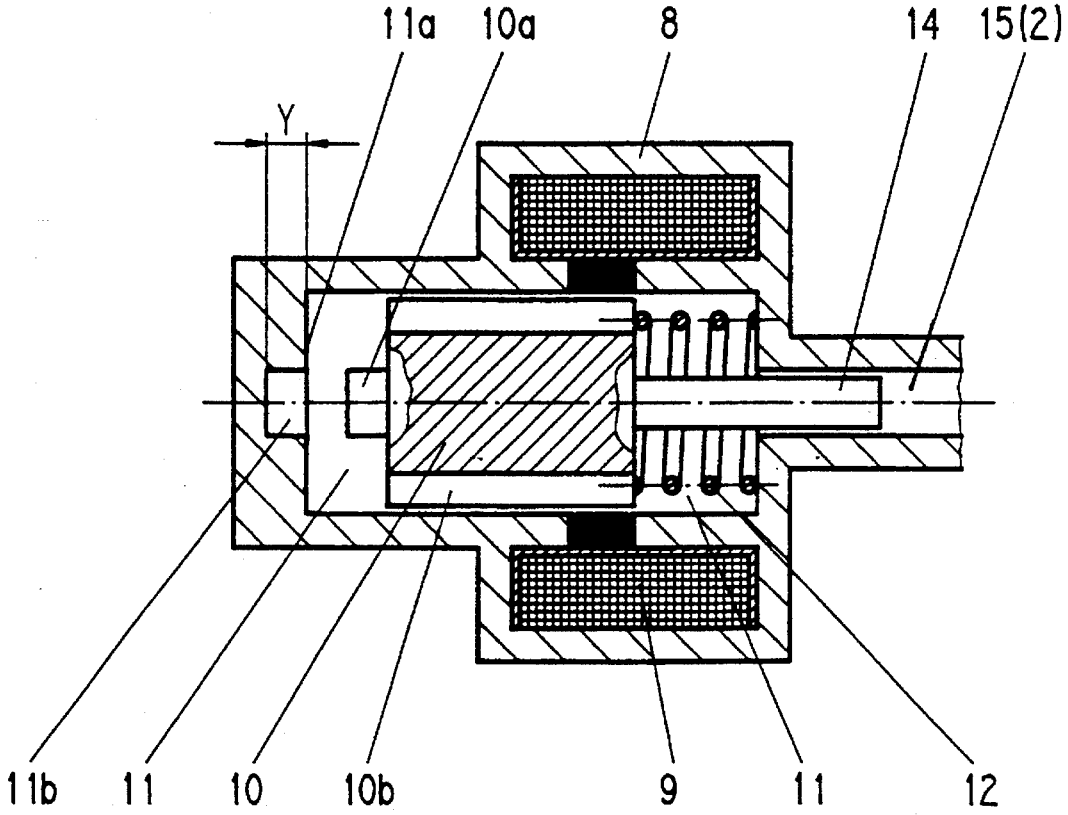

FIG. 9 shows an embodiment of the injection pump which is essentially of the same construction as that of the injection pump 1 as per FIG. 1. For the hydraulic damping there is an arrangement as is found on piston cylinders, consisting of a central cylindrical projection 10*a* on the rear of the rotor 10, whereby this projection in the last section of the rotor return movement fits and enters a blind cylinder bore 11*b* in the bottom 11*a*, which bore is in the stop face 11*a* for the rotor 10 in the housing 8. In the rotor 10 are longitudinal slots 10*b* connecting the space 11 at the rear of the rotor with the space 11 at the front of the rotor. In the space 11 is a medium e.g. air or fuel which during the cylinder bore 11*b* agrees approximately with the length of the projection 10*a* (dimension Y in FIG. 12). Because the projection 10*a* can enter the blind cylinder bore 11*b*, the rotor return movement in the last section is considerably retarded so that the desired hydraulic damping of the rotor return movement is achieved by displacement of the medium from the space 11*b*.

Figure 10A:
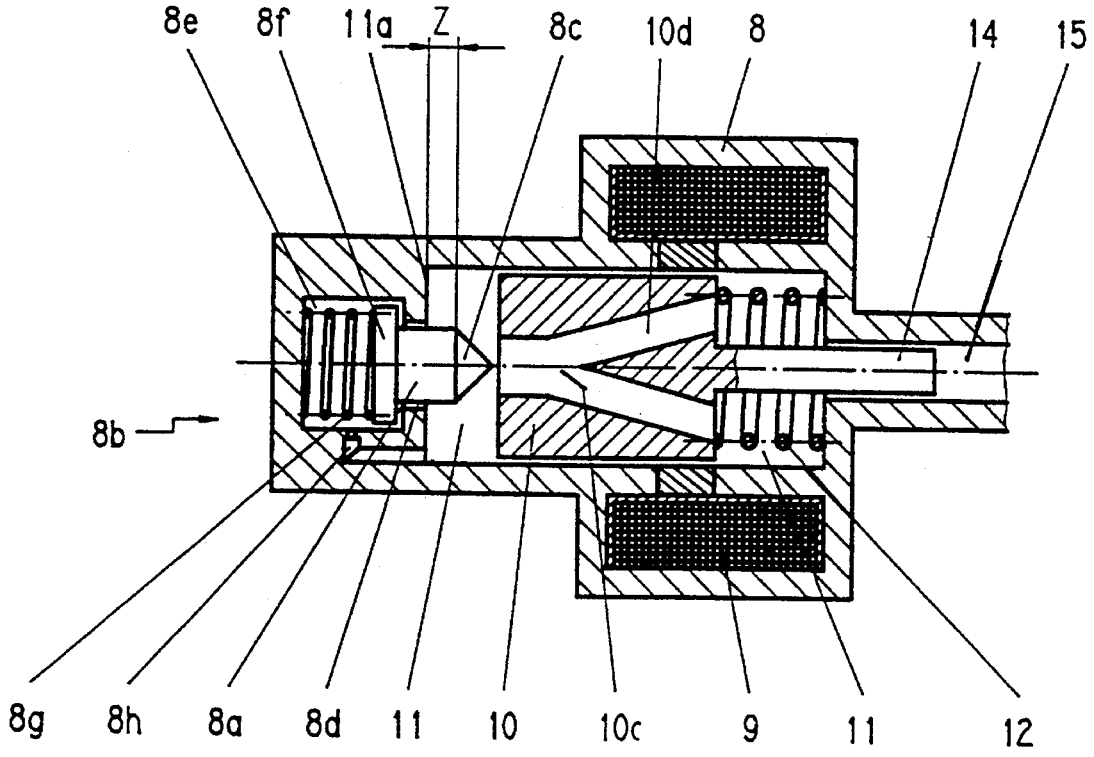

FIG. 10*a* shows a variant of the hydraulic damping. In this embodiment too, the pump space before the rotor 11 traversed by the delivery plunger 14 is connected before the piston 10 with the space 11 adjoining the rear of the rotor by means of bores 10*d*, which lead into a central transfer passage 10*c* near the rear of the rotor. A central pin 8*a* of a shock absorber 8*b* projects with its cone point 8*c* towards the opening of the transfer passage 10*c*, passes rearward through a hole 8*d* in bottom 11*a*, which leads into a damping chamber 8*e* and ends in the damping chamber with a ring 8*f* which has a larger diameter than the hole. A spring 8*g* braced against the bottom of the damping chamber presses against the ring 8*f* and therefore the pin 8*a* in its resting position (FIG. 10*a*). A passage 8*h* connects the damping space 8*e* with the rearmost rotor space 11. The passages 10*c* and 10*d* afford the rotor 10 an almost resistanceless movement during the acceleration phase.

The damping device 8*b* remains inoperative during the acceleration movement of the rotor 10, so that the stroke phase is not adversely affected. During the return movement the opening of the transfer passage alights on the cone point 8*c* and is closed, so that the flow through the passages 10*c* and 10*d* is interrupted. The rotor 10 presses the pin 8*a* against the spring force and against the medium in space 8*e* which is also in space 11 and flows out through the passage 8*h* into space 11. The flows and spring forces are so selected that optimum damping is ensured.

Figure 10B:
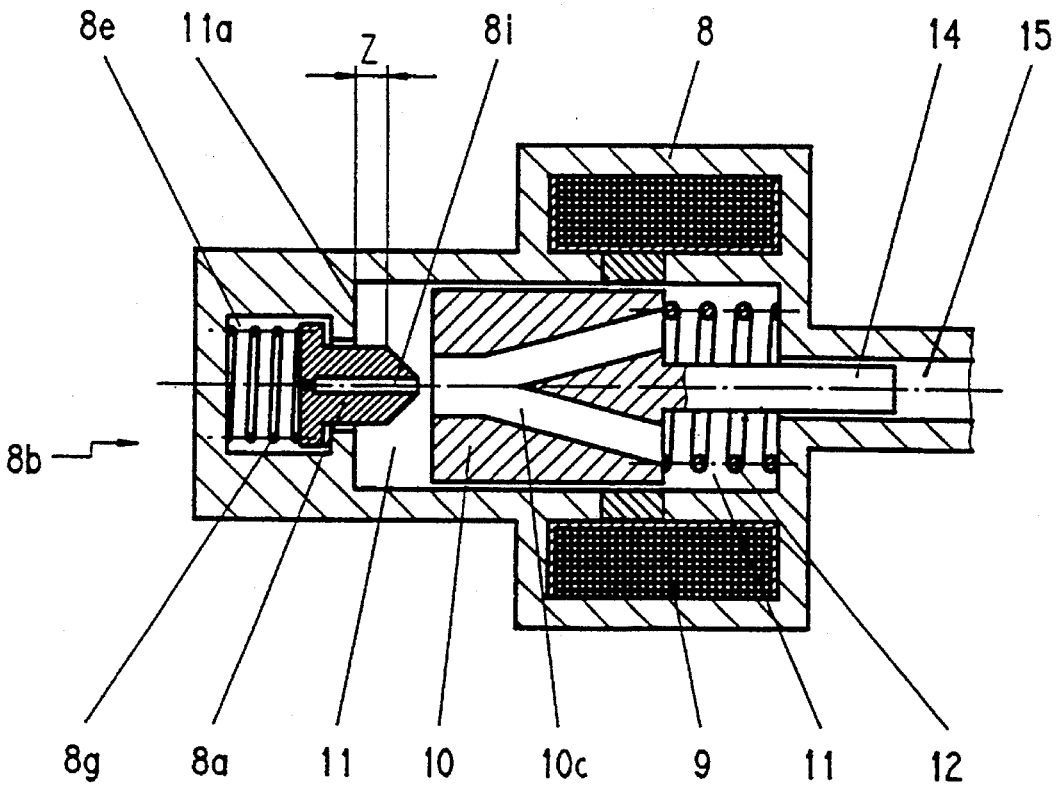

As FIG. 10*b* shows, it is also possible instead of the passage 8*h* to arrange a displacement bore 8*i* centrally in the pin 8*a* through which the damping medium can be pressed into the transfer passage 10*c*.

Figure 11:
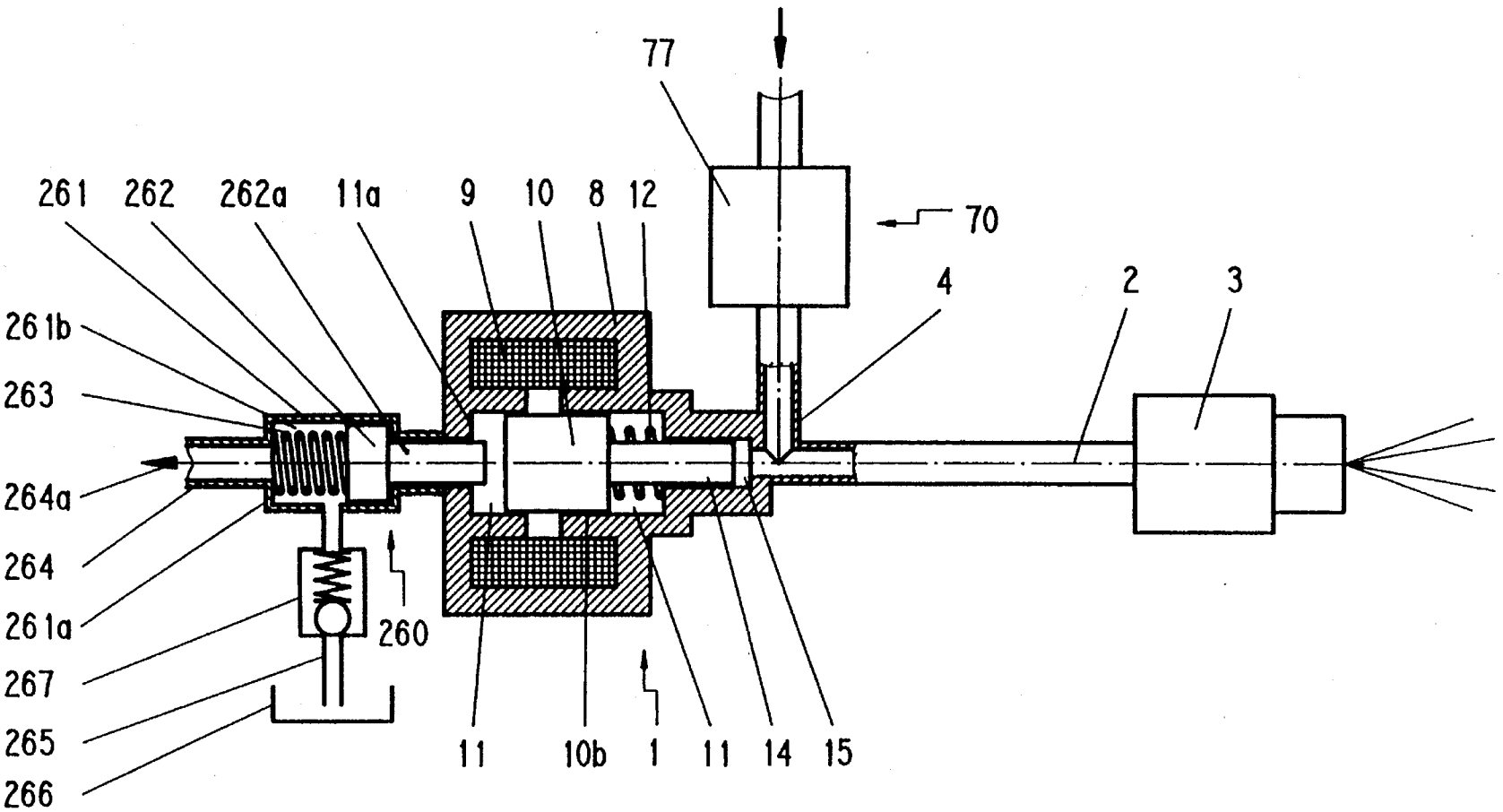

In accordance with a further advantageous development of the injection device as per invention, it is proposed to profitably use the energy stored in the return spring 12 of the rotor 10 during the return movement of the rotor 10. In accordance with the invention this can e.g. be achieved when the rotor on its return operates a pump device which can be used for the fuel supply of the injection device in order to stabilize the system and also to prevent the formation of bubbles or as a separate oil pump for engine lubrication. FIG. 11 shows such an embodiment of an oil pump 260 connected to the fuel injection pump 1.

The fuel injection device shown in FIG. 11 is for the rest of identical construction as the one in FIG. 4, therefore has a fuel supply control element and a fuel discharge control element for the control of the first stroke section of the delivery plunger 14. The oil pump 260 is connected to the rear bottom 11*a* of the pump housing 8. In detail the oil pump 260 comprises a housing 261, connected with the housing 8 of the injection pump, in the pump space 261*b* of which housing a pump piston 262 is arranged whose piston rod 262*a* protrudes into the working space 11 of the rotor 10, whereby the piston 262 is tensioned by a return spring 263 braced against the housing bottom 261*a* near an outlet 264.

Moreover, the pump space 261*b* of the housing communicates via an oil supply line 265 with an oil reservoir 266. In the oil supply line is a non-return valve 267 whose construction is similar to that of the valve 16 in FIG. 1.

The oil pump 260 functions as follows. When the rotor 10 of the injection pump is moved towards the injection nozzle 3 during its working stroke, the pump space 11 in the housing 8 behind the rotor 10 is increased in relation to its volume, so that the oil pump piston 262 is moved towards the rotor 10 and is finally transferred to its resting position through the action of the return spring 263. During this process oil is drawn from the reservoir 266 via the valve 267 into the working space 261*b* of the oil pump 260. During the return movement of the rotor 10 of the pump 1 toward its stop 11*a*, the oil pump piston 262 is pushed on at least a part of the return path of the rotor 10 into the oil pump space 261*b*. Thereby the valve 267 is closed by the pump pressure and oil is delivered by the oil pump via the outlet 264 in the direction of the arrow 264*a* and pressed to the engine locations to be supplied with oil.

The oil pump 260 can alternatively also be used as a fuel precompression pump, whereby the fuel can be supplied to the valve device 70. This has the advantage that the pump 260 can generate a static pressure in the fuel supply system which inhibits the formation of bubbles e.g. when the whole system heats up.

Furthermore, the invention-based construction of the additional pump 260 on the pump 1 causes rapid damping of the rotor 10 so that the rotor does not rebound at the stop 11*a*.

Figure 12A:
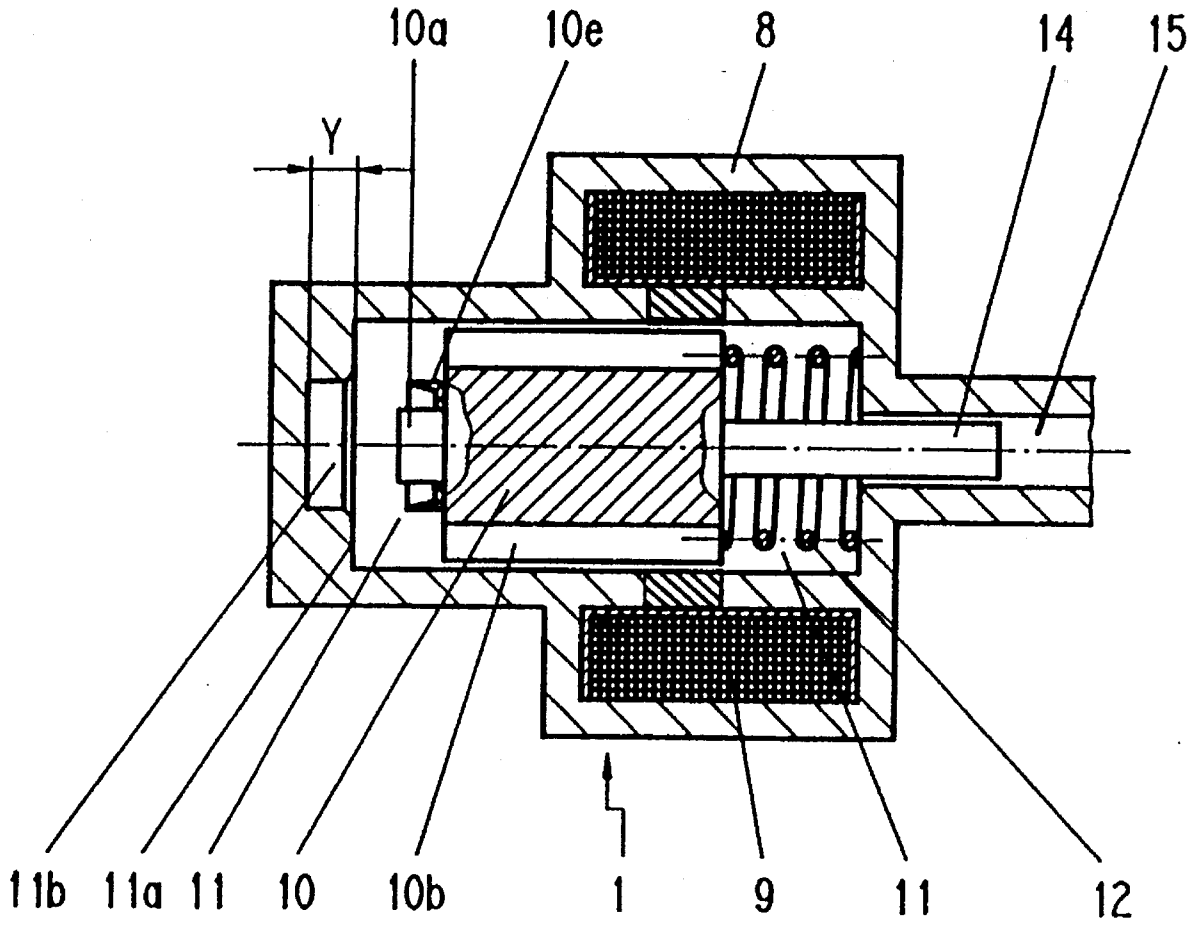
Figure 12B:
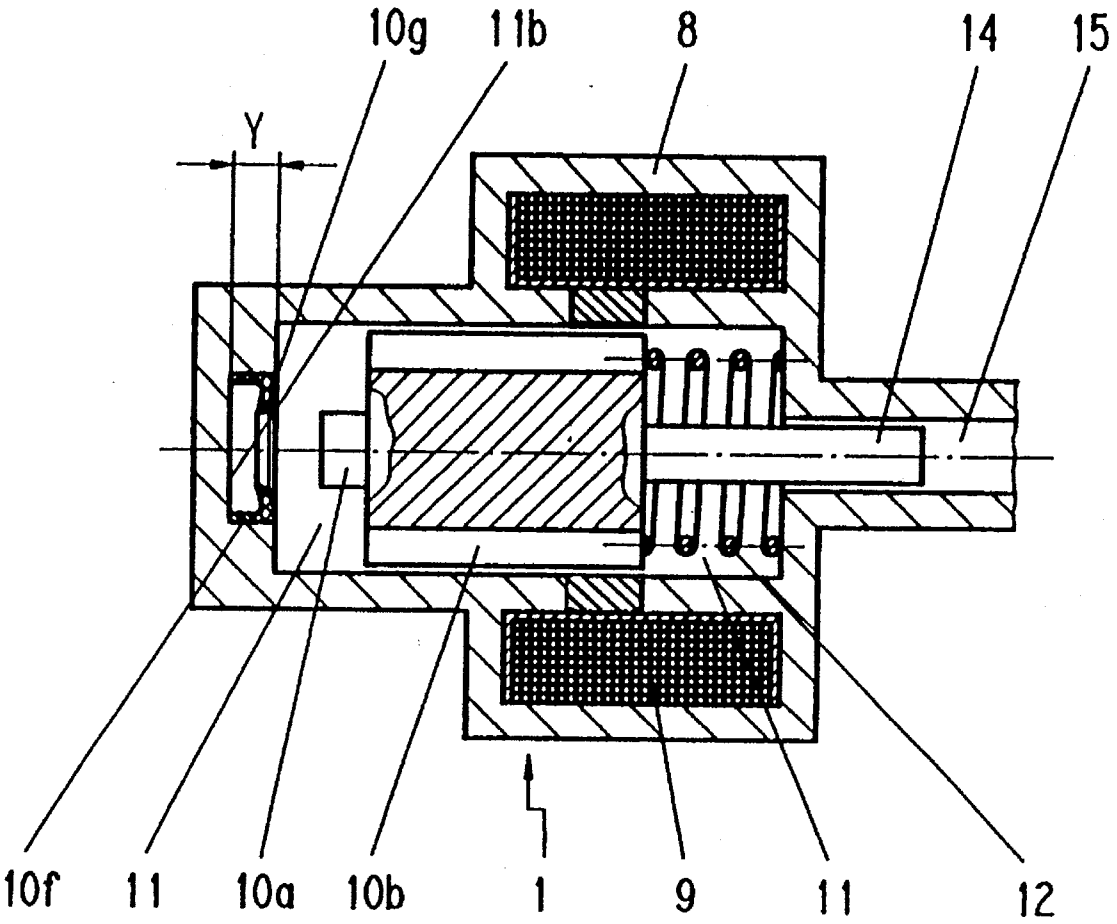

FIG. 12*a* and 12*b* show a particularly effective and simple damping device. The construction of the pump device 1 is similar to that in FIG. 9. The blind cylinder bore 11*b* as per FIG. 12*a* has a larger diameter than the diameter of the cylindrical projection 10*a*. The projection 10*a* is surrounded by a circular sealing lip 10*e* of an elastic material projecting towards the blind cylinder bore, this circular lip fitting in the blind cylinder bore 11*b*. An inlet inclination at the opening of the blind cylinder bore 11*b* facilitates the entry of the lips of the circular sealing lip 10*e* into the blind cylinder bore 11*b*. This damping device provides good damping at the impact of the rotor 10 and does not impede the acceleration stroke of the rotor. The elastic damping element 10*e* with axial parallel spreading sealing lips is positive-locking as it enters the blind cylinder bore 11*b* during the return stroke of the rotor 10 and comes to rest against and provides an outward seal for the inner wall of the blind cylinder bore 11*b*.

The blind cylinder bore 11*b* as per FIG. 12*b* likewise has a larger diameter than the cylindrical projection 10*a*. A sealing ring 10*f* of elastic material is positioned with positive fit on the wall of the blind cylinder bore 11*b* and, near the opening has seal lips 10*g* directed inwards. The cylindrical projection 10*a* enters the elastic sealing element 10*f* like a piston, whereby as a result of the outflowing damping medium, the seal lips 10*g* are pressed against the cylindrical projection 10*a* so that a particularly good damping of the rotor 10 is achieved.

Figure 13:
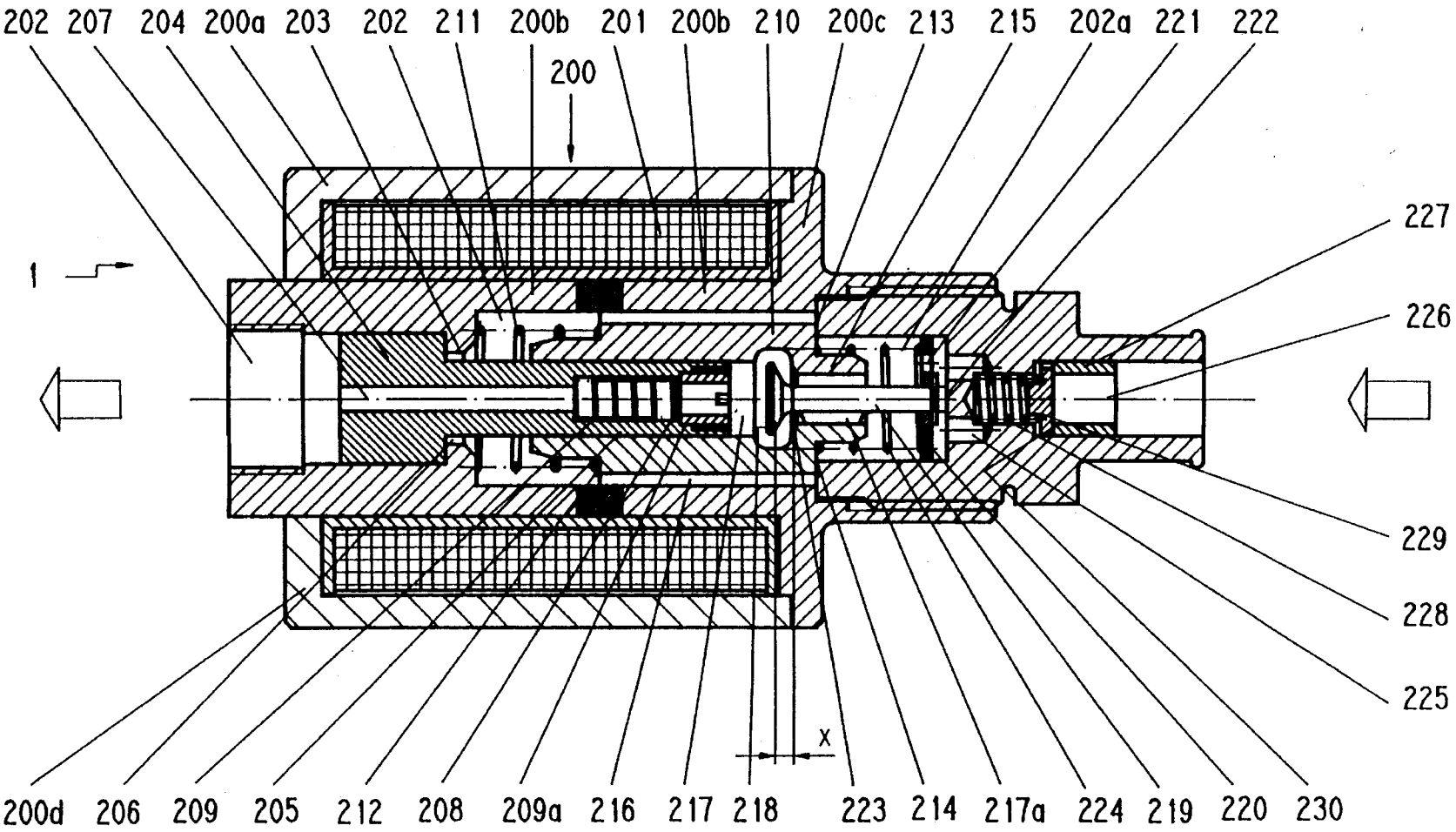

FIG. 13 shows a similarly compact construction of the electrically driven invention with an integrated stop valve. A coil 201 is arranged in a cylindrical multi-part housing 200 in an interior space 202 defined by an outer surface 200*a* and a cylindrical inner surface 200*b* as well as a tankside front wall 200*c* and a pressure-side front wall 200*d*. The cylindrical interior space 202 surrounded by the inner surface 200*b* of the housing is divided into an interior area on the tank side and one on the pressure-side by a ring 203 which radially extends inwards. On the pressure-side an annular ring 204 of a piston 205 which ring sits form-locking and firmly in this interior space has been put against the ring edge of the ring 203, whereby the piston 205 engages with clearance over the ring opening 206 of the ring 203 and projects into the tankside area of the interior space 202. The piston 205 is traversed by a throughbore 207 which widens at the tank-side end of the piston and there houses a valve 208 pressed towards the tank side into closing position against a valve seat 209*a* by a coil spring 209 and therefore can be opened by pressure coming frown the tank side.

On the part of the piston 205 in the tank-side interior space 202 there is, form-locking and slidable, a pump cylinder 210 of the reciprocating pump, which cylinder is pressed by a coil spring 211 braced on one side against the ring 203 and on the other against an annular step 212 of the cylinder 210, against the annular step 213 in the interior space 202, whereby a valve nipple 215 above the front face 214 protrudes with radial clearance some distance into the here radially narrowed interior space 202*a* and whereby the pressure-side annular front face of the cylinder 210 is arranged with clearance from the ring 203 and so motion space is created for the cylinder 210. The cylinder 210 accommodated form-locking on the inner wall of the interior space 202 has axial parallel, longitudinal slots 216, open at the front face in its surface, whose function is further explained below.

The through-bore 217 traversing the pump cylinder 210 and accommodating the piston 205, contains on the tank side, placed before the piston 205, a tappet valve, whose tappet head 218 is arranged spaced from the annular front face of the piston 205, in a short, widened bore section and whose push rod 219, braced against the inner wall of the bore 217*a*, passes through the narrowed bore 217*a* in the valve nipple 215 and protrudes into the narrowed interior space 202*a*.

At the free end of the push rod 219 a dish 220 is advantageously attached, the dish having holes 221 whose function will be further explained below, whereby the push rod 219 extends some distance past the dish 220 and strikes the tankside bottom 222 of the interior space 202*a*. The length of the push rod has been chosen so that the tappet head 218 is lifted from its valve seat, the opening 223 of the pressure-side narrowed bore 223, so that a specific gap "X" is formed, whose significance and purpose is further explained below. A coil spring 224 stabilizes this position of the tappet in the illustrated rest position of the reciprocating pump, while the spring 224 is braced on one side against the annular front face 214 of the cylinder 210 and on the other against the dish 220.

Axial parallel bores 225 extend from the bottom 222 into the bottom wall and exit in an axial valve space 226 where a valve head 229 is arranged, pushed towards the tank against a valve seat 227 by a coil spring 228, the valve head having slots 230 which can be covered peripherally by the valve seat 227, so that the valve can be opened by pressure on the tank connection side against the force of the spring 228 and a passage is created from the valve space 226 to the bores 225

The valve space 226 communicates with a fuel line to the fuel tank (not shown). A pressure line leading to the injection valve is connected to the front wall 200*d* or to an extended nipple of the inner wall 200*b* (not shown). The arrows in FIG. 13 indicate the fuel flow.

The reciprocating pump shown in FIG. 13 functions as follows. By the excitation of the coil 201 the cylinder 210 is accelerated from the resting position shown towards the pressure line virtually without resistance, whereby fuel flows off towards the interior space 202*a* from the space 202 via the slots 216 and from the bore 217 and the tappet head space. The accelerated movement ends abruptly with the impact of the valve seat 223 on the valve head 218 so that the stored energy of the cylinder 210 is transferred to the fuel in the tappet antechamber. The valve 208 is opened and the pressure on the fuel in the bore 207 and the pressure line is propagated so that ejection of fuel through the injection nozzle takes place. When the excitation is not yet switched off, fuel is ejected as long as the cylinder is displaced. Thereby the tappet valve 218, 219 is engaged by the cylinder and produces an underpressure in the interior spaces 202, 202*a* and in the bores 225 and the antechamber of the valve space 226 separated from the valve 229, so that the valve 229 is opened. The fuel flows from the tank passing through the peripheral slots 230 in the valve head 229, the antechamber of the valve space 226, the bores 225 and the holes 221 in the dish 220, into the interior space 202*a* and also via the slots 216 into the interior space 202. After the excitation is switched off, the cylinder is pushed back into its resting or initial position by the spring 211, whereby first the push rod 219 strikes the bottom wall 222 and the tappet valve is opened so that fuel can flow through the gap between the push rod and the bore 217*a* into the tappet head antechamber 217. The valve 208 remains closed. It functions as a static pressure valve and maintains, in the space filled with fuel between the injection valve (not shown) and the valve head 208, a static pressure in the fuel which is e.g. higher than the vapor pressure of the liquid at maximum operating temperature so that formation of bubbles is prevented.

Figure 14:
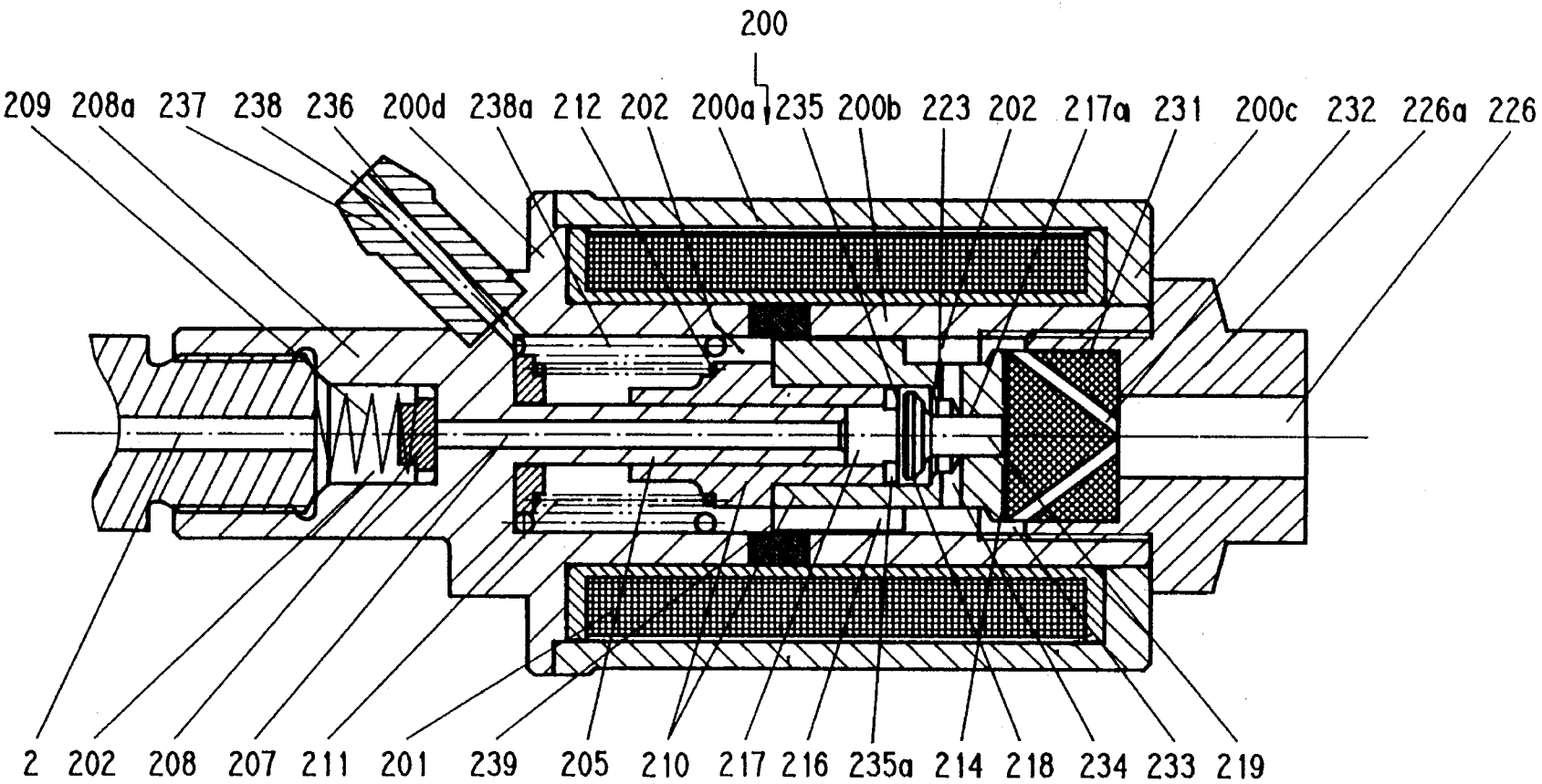

The embodiment of the injection pump in FIG. 14 which is similar to the embodiment shown in FIG. 13, hence the use of identical reference numbers, the piston 205 is formed in one piece with the front wall 200*d* and the static pressure valve 208, 209, accommodated in a nipple 208*a*, covers the pressureside opening of the bore 207 which passes through the piston 205.

The pump cylinder 210 functioning as rotor is of multi-part construction to facilitate mounting the push rod 218, 219. The multi-part construction is not an essential part of the invention and the cylinder construction is therefore not described in further detail.

The push rod 219 is relatively short and must not project beyond the tank-side annular front face 214 of the cylinder 210 by more than the valve clearance. In the area of the front wall 200*c* the annular front face 214 strikes against a plastic block 231 with through-bores 232 ending peripherally in slots 233 in communication with the tank-side interior space 202, whereby from the tankside interior space 202, bores 234 lead to the widened bore area of the bore 217 in the cylinder 210. The bores 232 exit in the axial valve space 226 leading to the tank, this space being housed in a nipple 26*a*.

With this embodiment of the invention the tappet valve 218, 219 is not spring-loaded. It functions through inertial forces whereby the push rod fits approximately form-locking in the narrowed bore 217*a*. In the position shown in FIG. 14 the tappet valve is pressed against the plastic block 231 by the existing pressure in the spaces 202, 217, 207 acting on the tappet head 218. When the cylinder 210 is accelerated, the tappet valve remains in this position until it is carried along from the valve seat 223. During the return movement of the rotor cylinder 210 the push rod 219 strikes the plastic block 231 so that the push rod reaches its indicated starting position again.

Advantageously the bore widening of the bore 217 which accommodates the tappet head 218, forms on the pressure-side an annular step 235 which in the resting position of the tappet valve is situated just before the tappet head 218 and strikes against the step of the tappet head 218, when the push rod due to inertia during the return movement of the cylinder 210, lifts from the valve seat and/or the valve would be bounced back from the plastic block 231 during the return movement of the cylinder 210.

Recesses 235*a* provided in the front face of the annular step 235 ensure free fuel flow. In this manner the resting position of the tappet valve is secured by simple means.

Figure 15:
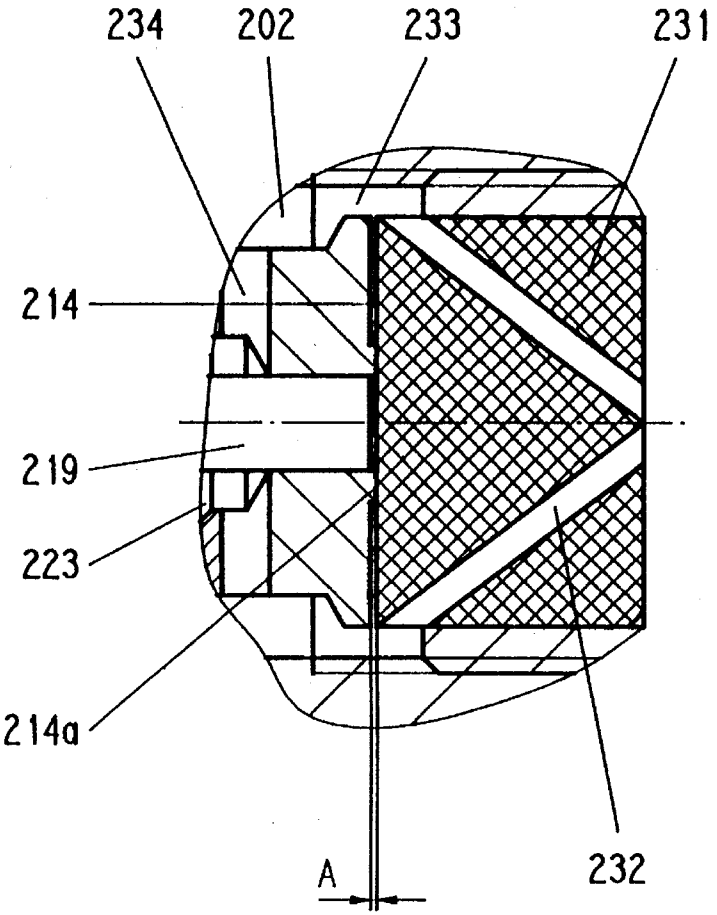

With this embodiment of the injection pump, fuel flows during the acceleration of the rotor-cylinder 210 from the pressure-side interior space 202 via the slots 216 into the tank-side interior space 202 as well as from the bores 207, 217 through the recesses 235*a* past the tappet head 218 through the valve seat opening into the bores 235 and also into the tank-side interior space 202. The displacement of the fuel is suddenly interrupted by the closing of the tappet valve 218, 219 so that the intended pressure impulse is generated. During the return movement of the rotor-cylinder 210 the tappet valve 218, 219 opens and fuel flows in the opposite direction. To make sure that the starting movement of the rotor-cylinder 210 from the resting position cannot be impaired, it is advantageously proposed that the annular front face 214 is arranged only distance "A" away from the surface of the plastic block 231 (FIG. 15). Bracing ridges 214*a* projecting from the annular front face 214 rest against the surface of the plastic block 231 and provide the distance "A" so that no disturbing underpressure effect can occur at the start of the rotor-cylinder 210 between the annular front face 214 and the surface of the plastic block 231. Similar bracing ridges for the same purpose can also be arranged on the front face of the push rod 219 (not shown). Additionally, the small distance "A" has been chosen so that during the return stroke, damping through squeezing out of fuel from gap "A" occurs.

Figure 16:
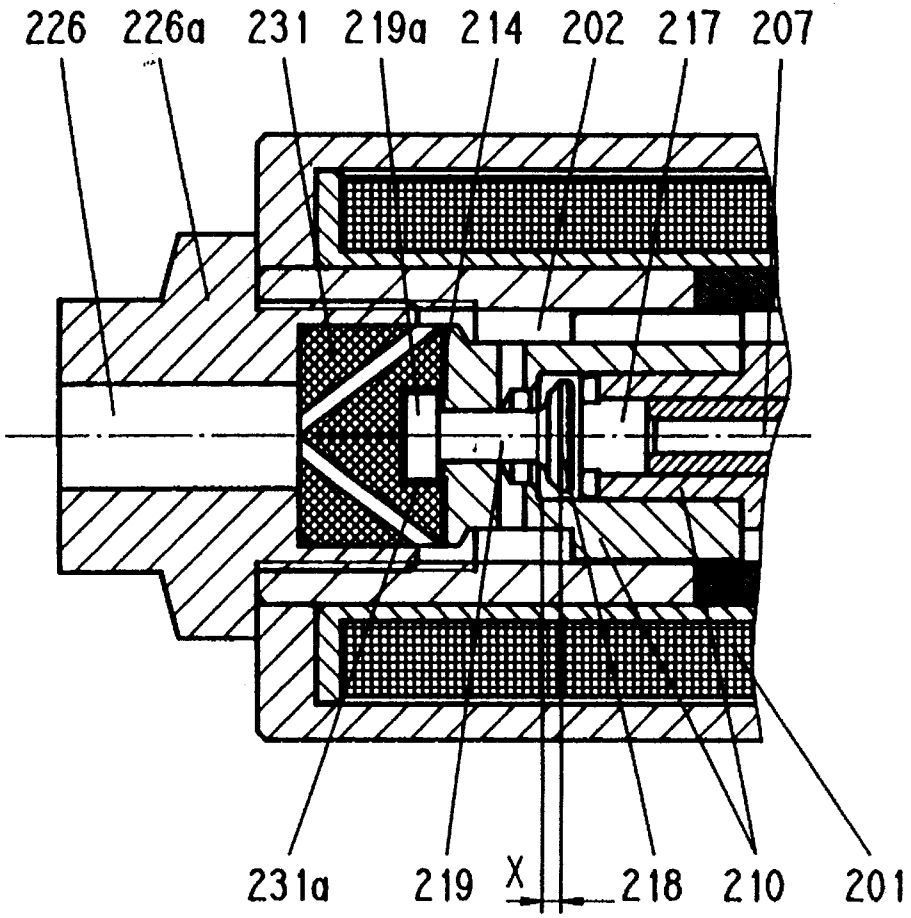

The embodiment of the reciprocating pump as per FIG. 14 and 15 can be equipped with a simply constructed effective rotor damping device as shown in FIG. 16. In this case the push rod 219 has at its free end a flanged ring 219*a* which engages over part of the side of the annular front face 214 and can rest against the annular front face 214. In the surface of the plastic block 231 is a recess 231*a* matching the flanged ring 219*a* in which the flanged ring 219*a* fits approximately form-locking, so that a piston cylinder-like hydraulic damping device is formed. During the return movement of the rotor-cylinder 210, the flanged ring 219*a* with following is taken along from the annular front ace 214. As soon as the flanged ring 219*a* enters the recess 231*a*, fuel is displaced from it and deceleration of the rotor-cylinder 210 results. During the acceleration of the rotor-cylinder 210 the rotor-cylinder moves almost without resistance. The flanged ring 219*a* and with it the tappet valve 218, 219 first remains first in the recess 231*a* until the entrainment of the tappet valve by the valve seat occurs.

Advantageously, the thickness of the flanged ring 219*a* is made a little greater than the depth of the recess 231*a*, so that in the resting position of the rotor cylinder 210, the annular front face 214 remains separate from the surface of the plastic block 231 and bracing ridges then are not required.

Advantageously, there is in the pressure-side front wall 200*d* a bore 236, leading from the pressure-side interior space 202 to the outside and on which bore there is on the outside a nipple 237 with a through-bore 238. During the starting phase of the pump and the engine it is e.g. possible to pump fuel from the rotor-cylinder 210 through the bore 236 and the discharge nipple 237, so that the pump and/or the fuel supply line can be flushed clear of air bubbles. It is however also possible to flush fuel through the outlet 236, 237 during the injection activity and so to evacuate heat and avoid the formation of bubbles.

Advantageously there is on the inner wall of the pressure-side interior space 202 a pressure spring 238 braced against the front wall 200*b* which an annual front face 239 of the rotor-cylinder does not strike during the acceleration of the rotor-cylinder 210 until a large stroke for a large quantity of injection fuel is initiated. The spring is then compressed. During the return movement of the rotor-cylinder 210 the spring 238 transfers its stored spring force to the rotor cylinder 210 so that it moves correspondingly faster into the resting position.

Figure 17:
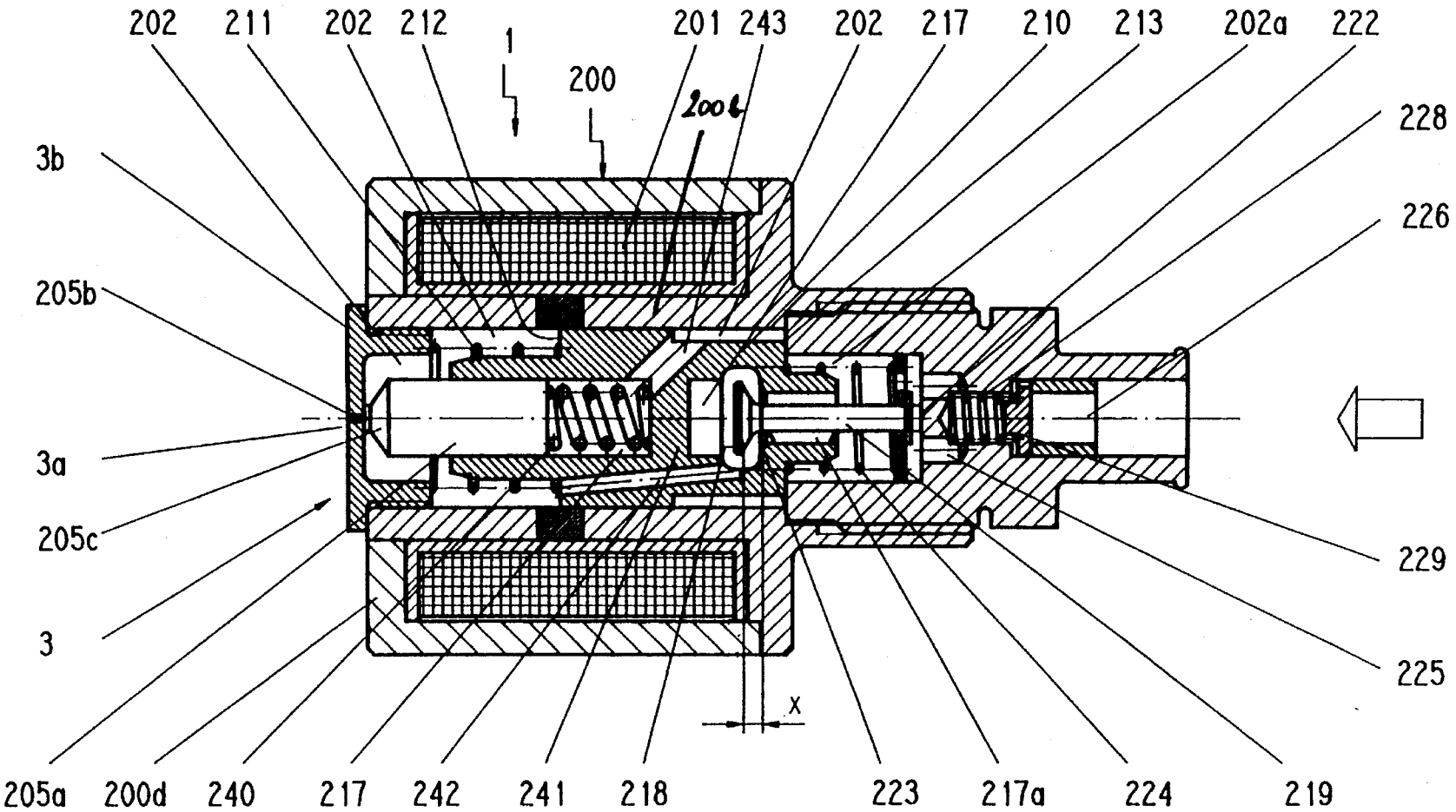
Figure 18:
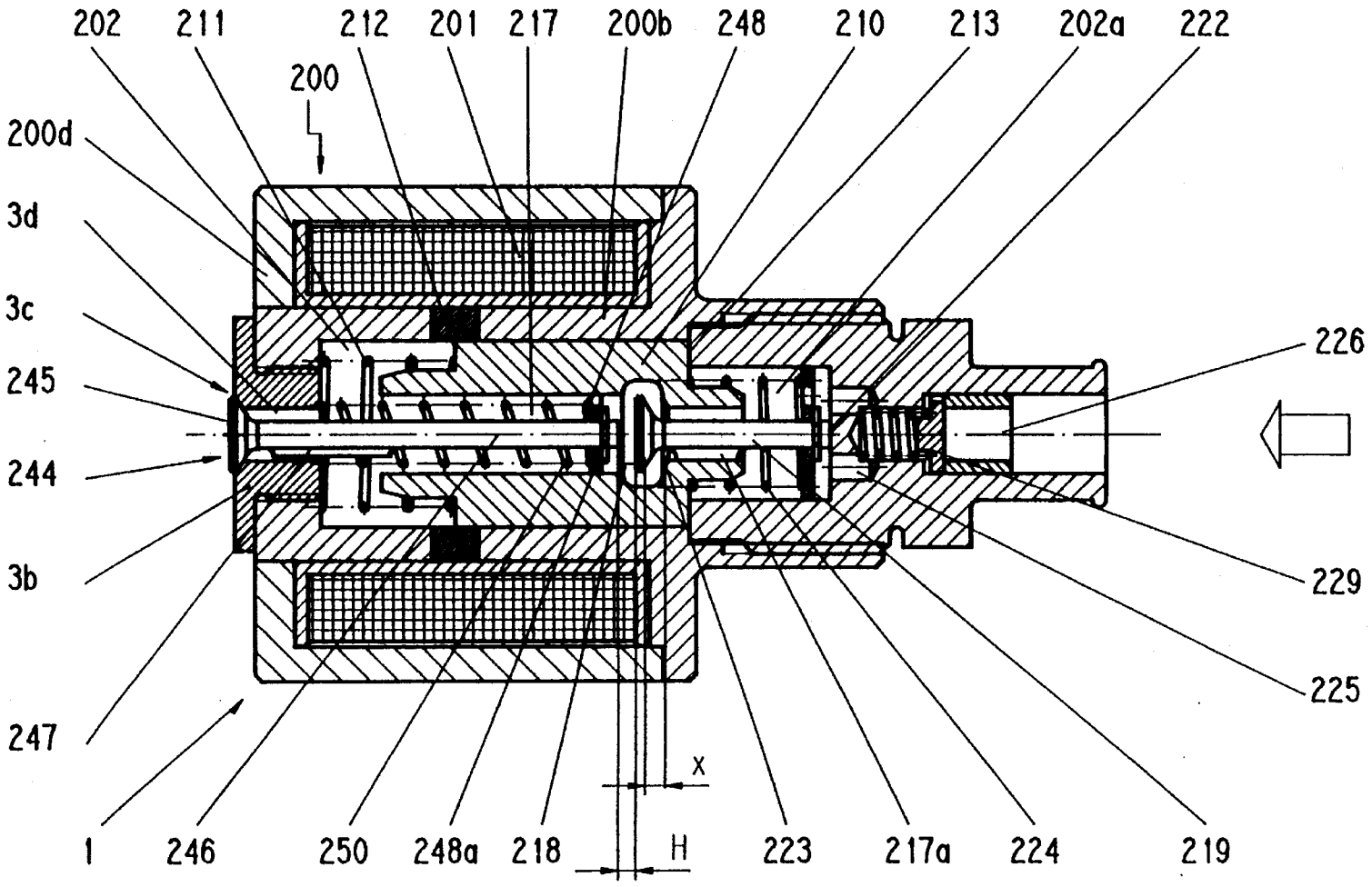
Figure 19:
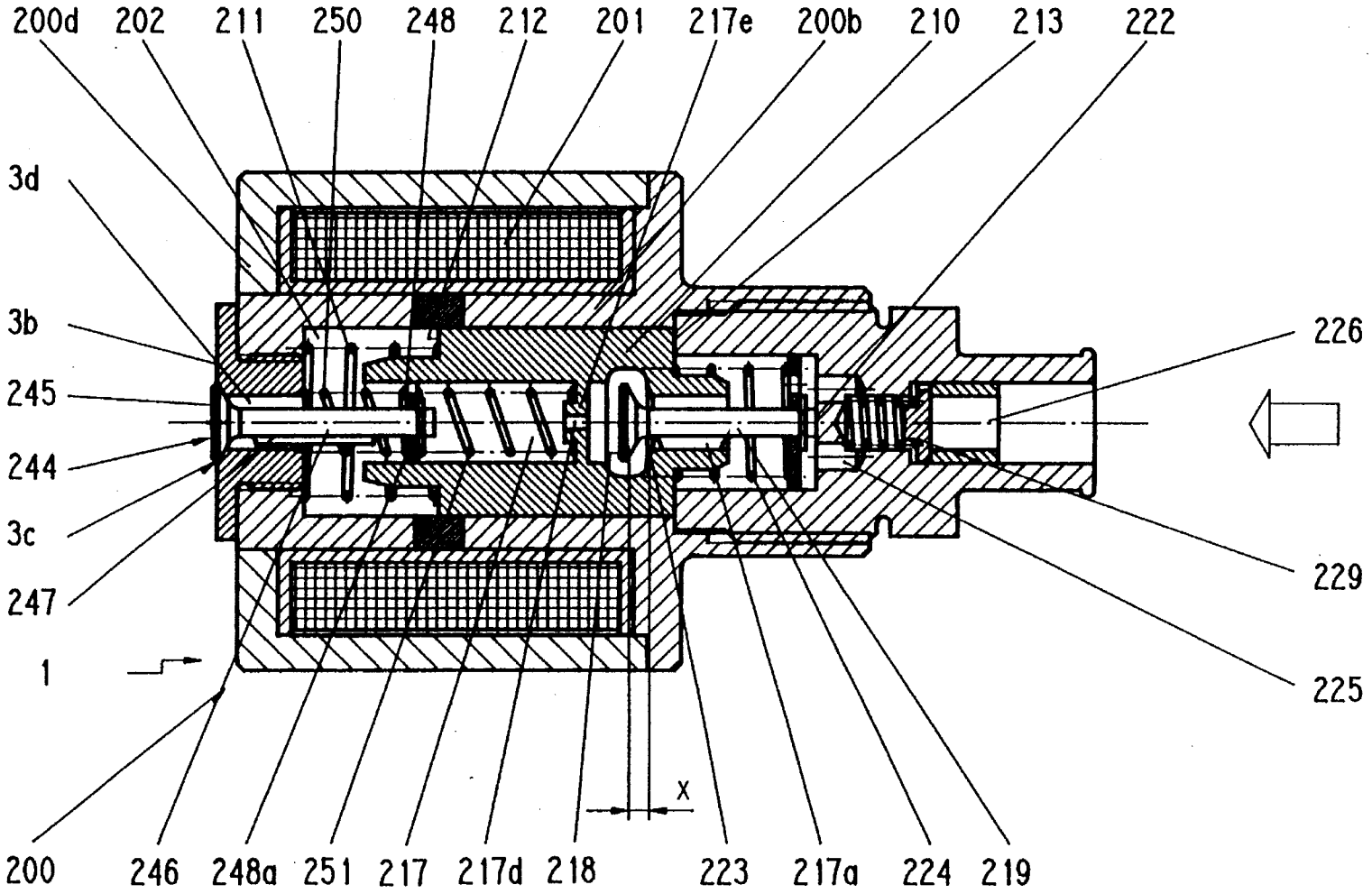

With the following reciprocating pumps described on the basis of FIG. 17, 18 and 19, the cylinder 210 functions as a piston-like rotor element carried liquid tight in the inner cylinder 200*b*.

An injection pump 1, similar to the injection pump shown in FIG. 13, is shown in FIG. 17, whereby identical parts have been given identical reference numbers. The piston 205*a* partly accommodated in the rotor-cylinder bore 217, is not attached to the pressure-side front wall 200*d*, but carried axially movable and is a part of the injection valve device 3. The injection valve 3 has a valve cap 3*b* screwed into the front wall 200*d* of the housing 200 and engaging the interior space on the injection valve side 202. The valve cap has a central injection nozzle bore 3*d*. In its resting position the piston 205*a* covers the injection nozzle bore 3*a* with a front face of reduced diameter 205*b* The reduced diameter face 205*b* changes over with a truncated cone into the cylindrical part of the cylinder 205*a*. The piston 205*a* is pressed against the injection nozzle bore 3*d* in the rotor cylinder bore 217 by a pressure spring 240, whereby the pressure spring is braced at the other end against a partition 241 arranged in the rotor-cylinder bore 217, this partition dividing the bore 217 into an area on the injection nozzle side and one on the tank side. At least one bore 242 runs from the annular front face 212 through the rotor-cylinder 210 into the widened cylinder bore space of the tank-side area of the bore 217, in which the tappet head 218 is accommodated, and one bore 243 runs through the rotor cylinder 210 from the area of the bore on the injection nozzle side 217 into the tank-side interior space 202, whereby the middle area of the rotor-cylinder 210 fits form locking and almost fluid-tight against the inner wall of the interior space 202. Preferably, the rotor-cylinder has slots in the tank-side area of the interior space 202, whereby the slot passages rest against the inner wall of the interior space 202 and there form guideways for the rotor-cylinder 210.

The injection pump as per FIG. 17 functions as follows. When the rotor-cylinder 210 is accelerated first without resistance, fuel flows via the bore 242 into the tank-side space of the bore 217 and from there into the space 202*a*, whereby the valve 229 remains closed. Additionally, fuel flows through the bore 243 from the space on the injection valve side oil the bore 217 into the tank-side interior space 202 and from there—because the rotor-cylinder 210 has lifted off the annular front face 213—through the gap so formed also into the space 202*a*. As soon as the tappet valve 218, 219 is engaged by the valve seat, the desired pressure impulse is produced in the interior space on the injection valve side 202. The pressure impulse is transferred to the conical surface of the truncated cone 205*c* and lifts the piston 205 against the pressure of the spring 240 from the nozzle 3*a*, so that fuel is ejected. Simultaneously, an underpressure is produced in the space 202*a* and in the tank-side interior space 202. This underpressure also acts on the piston 205, but its force is much less than the spring force of the spring 240, so that there is no effect on the piston. However, the underpressure opens the valve 229 so that additional fuel is sucked in. The valve 229 closes again through the spring force of the spring 228 when the return movement of the rotor cylinder 210 begins, so that then through the rotor cylinder movement fuel is pushed into the spaces of the bore 217 and of the interior space 202. The function of the valve 292 is identical to the function of the same valve 229 in the embodiment of the injection pump 1 as per FIG. 13.

A further embodiment of the injection pump 1 as per invention, in which the injection nozzle 3 is accommodated directly in the front wall 200*d* in the housing 200 of the injection pump 1, results from FIG. 18. This embodiment is similar to that of FIG. 17, for which reason identical parts have been given identical reference numbers.

The valve cap 3*b* forms in this case a valve seat 3*c* for a tappet valve 244 whose valve head 245 is pulled from outside against the valve seat 3*c* and whose push rod 246 passes through the cap bore 3*d* following after the valve seat 3*c*, free or radially braced by ribs 247, and also passes free through the rotor cylinder bore 217 and ends a short distance before the widened area of the bore 217, which area accommodates the tappet head 218 of the tappet valve 218, 219. At the free end of the push red 246 a ring 248*a* with holes or a peripheral recess is attached, against which ring a pressure spring 250 is braced on the injection valve side, while at the other end the spring rests against the front wall 200*d* of the housing 200 or against the valve cap 313. The essential point of this embodiment is that the rotor cylinder 210 has only the through-bore 217 and no peripheral slots, but rests form-locking against the inner wall of the interior space 202. This injection pump which has no piston, functions unlike the embodiment as per FIG. 17 as follows. When the tappet valve 218, 219 is carried along from the valve seat of the rotor cylinder 210, the sudden pressure build-up in the fuel in space 202, 217 and 3*d* occurs, so that the tappet valve 244 opens against the pressure of the return spring 250 for the ejection. Subsequently the tappet head 218 after a further stroke distance strikes the push rod 246 and keeps the valve 244 open.

FIG. 19 shows an embodiment of the injection pump 1 as per invention similar to the one shown in FIG. 18, whereby identical parts have again been given identical reference numbers.

The push rod 246 of the tappet valve 244 is shorter and in the resting or starting position of the pump 1 only reaches as far as the final part of the rotor cylinder bore on the injection valve side 217. Accordingly, the return spring 250 is also of shorter design. Additionally however, a further pressure spring 251 presses from the tank side against the ring 248*a*, which is braced at one end against a wall 217*e* with a central bore 217*d*, this wall dividing the bore 217 into an area on the injection valve side and one on the tank side, these areas communicating via the bore 217*d*.

With this version the injection pump 1 supports the spring 251 of the valve 244 as in the case of the embodiment as per FIG. 18, where the pushing open is supported by the valve head 218, which impacts with the push rod 246. The springs therefore hold the valve 244 in the open position as long as the spring force of the spring 250 or 251 brings this about.

The injection device as per invention enables engine start or engine emergency running without a battery. This possibility is described in more detail below on the basis of FIG. 20, 21, 22.

Electrically driven or electronically controlled injection requires sufficient electrical energy for starting and running. In the case that sufficient electrical energy is not available, the invention proposes the possibility of starting engines with injection as per the invention even without electrical energy, for instance through manual cranking. The required fuel is made available by an auxiliary device as explained more fully below. When the engine reaches a speed at which the generator produces sufficient energy, the auxiliary device is switched off as per the invention and the injection reverts to the normal electrical or electronic mode.

There are engines which can be started without electrical energy, e.g. by a manual or kickstart device. Among these are small engines of hand tools, two wheeled vehicles or speedboats. This starting device is necessary, because there is no battery for starting and/or running. Engines should in any case be startable even without a battery, e.g. in the case of a flat battery.

The starting of engines without electrical energy by means of an auxiliary device is achieved according to the invention by utilizing the fuel supply arrangement available on every engine at starting speed, e.g. the feed height or the pressure of the fuel pump. The fuel is thereby fed directly to the suction line or the transfer ports in two-stroke engines or to a metering device. When the engine reaches a speed at which the generator delivers sufficient energy for the injection device, a valve blocks the direct fuel supply to the engine, the fuel is fed to the injection device and this then takes over the fuel supply of the engine.

FIG. 20 shows an arrangement for the fuel supply of an engine 500 as per the invention. This includes a branching of the fuel supply line to the engine after a fuel precompression pump 501 connected on the inlet side with a fuel reservoir 502. In the de-energized state, an injection device 504 constructed according to one of the foregoing embodiments and connected to a generator 503, is inactive and a control valve 505 which is e.g. operated electromagnetically, is open for the fuel supply to an atomizer 506 on the engine 500.

When the engine 500 is started, the fuel pressure delivered by the precompression pump 501 is supplied via the open control valve 505 to the atomizer 506 on the engine 500. The flow resistance of the control valve 505 and/or of the atomizer 506 is so determined that with the pressure delivered by the precompression pump 501 at engine starting speed, the fuel requirement for starting is covered. When the generator 503 coupled to the engine reaches a speed at which the energy requirement of the injection device is covered, an injection control 507, also fed by the generator 503 and connected via a control line to the injection device 504, becomes active. Additionally, the control valve 505 is closed by means of a current signal so that no more fuel can be supplied direct to the engine. Simultaneously the injection device 504, controlled by the injection control 507, takes over the injection through the injection nozzle 508.

A hand pump 509 found on many engines can if necessary be used as well during starting for the direct fuel supply via the atomizer 506 to the engine. The hand pump 509 is arranged in the connection line 511 from the pump 501 to the control valve 505. The control valve 505 is triggered by the injection control 507 via a control line 510.

FIG. 21 shows a variation of the arrangement as per FIG. 20, whereby the control valve 505 is arranged in the injection line 511 between the injection device 504 and the injection nozzle 508. The function of currentless starting is identical to the function explained above on the basis of FIG. 20.

To ensure the fuel flow through the injection device 504 without pump support, the flow resistance of the injection device 504 is kept low. It is thereby advantageous that the venting of the injection device 504 and the injection line 511 is possible without problems. If the injection device 504 must be vented, the control valve 505 is de-energized through a cutout 512 in the line from the injection control 507 to the control valve 505, insofar as this has not already been done by the injection control 507. This opens the control valve 505 towards the atomizer 506 and the air in the system can escape during simultaneous pumping, e.g. with the precompression pump 501 or the hand pump 509.

Based on FIG. 22 there now follows a detailed description of emergency running without a battery as per the invention.

The arrangement shown in FIG. 20 and 21 can also be used for emergency running, when e.g. there is not sufficient energy available for the injection control and the injection device due to generator failure. The invention proposes a variation in the fuel quantity by means of a metering device, e.g. an adjustable throttle in the control valve coupled to the throttle valve in the air intake, so that temporary control of the engine load is possible.

FIG. 22 shows an embodiment of the control valve or the metering valve 505 as per FIG. 20 and 21 suitable for this purpose. The control valve 505 has a housing 520 containing a coil 521 serving to drive a rotor 522 which is supported slidable in a bore 523 of the housing 520 and is in its resting position pushed against an adjustable stop 525 arranged in the housing 520 by a return spring 524, while outside the housing a cable pull 526 is connected to the stop. The rotor 522 has peripheral longitudinal slots 527 which allow communication of fuel in the bore 523 between the front and back of the rotor 522. The bulb-shaped stop 525 passes through the housing front wall **520*b* and is pretensioned in the housing 520 in relation to the housing front wall 520*b* by a spring 528**.

The embodiment also involves a metering piston 527 of uniform construction with the front face of the rotor 522 opposite the stop 525. This front face is also tensioned by the return spring 524, which is braced at the other end against the front wall **520*a* of the housing 520. The metering piston 527 protrudes with a tapered tip into the delivery line 511 from which moreover a connection line 511*a* branches off to the atomizer 506**.

The cable pull 526 connected to the stop 525 which is pretensioned by a spring against the rotor 522, is connected to the throttle valve 530 (see FIG. 21, 22). The throttle valve position is therefore directly transferred to the stop 525.

The-function of the control valve 505 is as follows. In the de-excited state of the coil 521, rotor 522 and metering piston 527 are held against the stop 525 by the return spring 524. The fuel coming from the delivery pump 501 can flow through the delivery line 511 to the atomizer 506. If the control valve 505 is excited by the control device, the rotor 522 pushes the metering piston 527 against the force of the spring 524 in the delivery direction until the supply cross-section 531 of the delivery line 511 is closed.

If in an emergency the engine is run without injection, the control valve 505 is currentless and the supply cross-section 531 in the line 511 to the atomizer is therefore released. Depending on the throttle valve position, the conical metering piston 527 is pushed to a varying depth via the rotor 522 through the stop 525 into the bore of the supply cross-section. The coupling to the throttle valve 530 is thereby so selected that as the throttle valve 530 opens wider, the cross-section 531 is opened further. In the idling position of the throttle valve 530 a minimum gap remains at the cross-section 531, which allows the fuel idling quantity to pass through to the atomizer 506.

FIG. 23 shows a preferred circuit for the triggering of the rotor excitation coil of the invention-based injection pump, which ensures optimum acceleration of the rotor.

It is known how to effect the metering of the fuel to be injected by e.g. timing. However, a purely time-based control has been found disadvantageous, because the time window between minimum and maximum fuel quantity to be injected is too small to control the quantity spectrum for engine operation in a sufficiently differentiated and reproducible manner. However, the invention-based pure intensity control of the current flow provides a sufficiently differentiable metering method.

In the case of the electromagnetic drive of the invention-based fuel injection device, the excitation, i.e. the product of the number of turns of the coil and the intensity of the current passing through the coil, is of particular importance for the electromagnetic conversion. This means that an exclusive control of the current amplitude makes it possible to select a clearly defined design of the switching performance of the drive magnet, independent of the influences of coil heating and a fluctuating supply voltage. Such a control is particularly responsive to the strongly fluctuating electrical voltage levels and the temperature variations usual in engines.

FIG. 23 shows a two-step control circuit as per the invention for the current amplitude of a current controlling a pump drive coil 600. The drive coil 600 is connected to a power transistor 601 which is grounded through a measuring resistor 602. The output of a comparator 603 is hooked on to the control input of the transistor 601, e.g. to the transistor base. A current set point is applied to the non-inverting input of the comparator. This set point is e.g. obtained from a microcomputer and the inverting input of the comparator 603 is connected to the transistor 601 on the side of the measuring resistor.

To control the energy flow in the drive coil 600 independently of the supply voltage, the current consumed by the coil 600 is measured by the measuring resistor 602. When this current reaches the limit value given by the microprocessor as set point, the comparator switches off the current for the coil 600 via the power transistor 601. As soon as the actual current falls below the current set point, the transistor switches the coil current on again via the comparator. The current rise delay caused by the inductivity of the coil 600 prevents that the maximum permissible current is exceeded too rapidly.

After that the next switching cycle can begin and this clocking of the coil current of the coil 600 continues as long as the reference voltage supplying the current set point prevails at the non-inverting input of the comparator 603.

The circuit represents a clocked power source, whereby the clocking only sets in after the current set point supplied by the microprocessor has been reached. The energy and with it the quantity control of the pump device 1 can be carried out with this circuit in a combination of the duration and/or intensity of the reference voltage supplied by the microprocessor.

FIG. 24, 25 and 26 show particularly advantageous embodiments of the injection nozzle (e.g. nozzle 3) for the invention-based injection device.

This injection nozzle comprises a valve seat pipe 701 against whose free lower end the diaphragm 704 is arranged, if required a jet-forming plug insert 702 (positioned in a central perforation of the diaphragm 704), a nozzle holder 703, a diaphragm plate 704 pretensioned towards the valve seat, a spring ring 705, a pressure line 706, leading on the side of the valve seat into a ring channel 708 open towards the diaphragm 704 and covered by the diaphragm, a pressure screw 707, a seal 709 for the nozzle holder 703 and a mounting 709 for the nozzle holder 703.

With the diaphragm flat seat nozzle with nozzle pin 702 (FIG. 25) and without nozzle pin 702 (FIG. 26) shown in FIG. 24, 25 and 26, good fuel atomization at the surface of a domed cone-shaped shell is achieved. The form and dimensions of this cone-shaped shell depend among other things on the dimensions and the design of the outlet in the diaphragm (FIG. 25) and can if necessary be further adapted to engine operation with the known functional advantages by means of an alignment lug or a throttle plug.

The valve operates almost without moving masses and is characterized by a specially designed metal diaphragm cooperating with a fixed flat valve seat. The diaphragm -at the same time valve spring because of the initial tension can be pretensioned against the opening direction (e.g. by arching) by suitable defined and permanent deformation. This way it is possible to improve the fuel atomization at low pressures before the nozzle opening formed by the central perforation in the diaphragm 704, e.g. at low engine speed and small injections (with low part-load operation). The machining of the nozzle hole (rounding of edges etc.) is possible without difficulty from both directions.

To increase the good closing effect at the valve of the outward-opening injection nozzle, the seat ring width of the flat seat (FIG. 25) can be attuned to the initial tension of the diaphragm plate. The right choice of the dimensions of the lower ring recess contributes to this, because this produces the force acting on the diaphragm at the given static pressure of the fuel before the valve seat. On the other side the diaphragm is cooled effectively by the fuel present in the ring recess or flowing through it.

The-nozzle does not require lubrication and is therefore particularly suitable for petrol, alcohol and mixtures of same. Because of the mode of operation—there is no volume downstream of the valve seat—comparatively lower engine hydrocarbon emissions can be expected in this nozzle than in nozzles opening inwards.

The nozzle consists of few parts, its manufacture in mass production, maintenance, checking and parts replacement is therefore very simple and economical.

Fuel supply systems for fuel injection devices are flushed with fuel during operation for cooling and evacuation of vapor bubbles. This means that the fuel pump supplies a larger quantity of fuel than the engine requires. This excess is returned to the tank via a line and serves for the elimination of heat and for the evacuation of vapor bubbles. Vapor bubbles result from engine operating heat and can disturb or even prevent the functioning of the injection device. Restarting a still warm engine can also be made more difficult or even impossible by vapor bubbles.

For certain engine applications e.g. as an outboard engine on boats, a return line to the tank is not permitted by the law on safety grounds.

A fuel supply system with an invention-based injection device is therefore designed without a return line to the tank in accordance with a further embodiment of the invention, whereby heat and vapor bubbles can however be eliminated.

The invention solves this problem by using a second fuel pump, a gas separation chamber with float valve and a condenser. This arrangement can be mounted direct on the engine and so avoids pressurized fuel lines outside the engine compartment or the engine enclosure. This meets the legal safety requirements.

On the basis of FIG. 27 an example of this fuel supply device is explained more fully below.

A pump 801 draws the fuel 802 from the tank 803 and transfers it through a fuel line 804 to a gas separation chamber 805. The gas separation chamber 805 has a float 806 operating a vent valve 807, which communicates with a gas discharge line 808 arranged in the headroom above the liquid surface 805*a*.

A fuel line 809 branches off from the bottom of the gas separation chamber 805 and this fuel line is connected with a pump 810 and leads to an invention-based injection valve 811 which is connected with the gas separation chamber 805 via a fuel line 812 which leads into the gas separation chamber 805 above the liquid surface 805*a*. A pressure regulator 813 and a condenser 814 are respectively inserted in the fuel line 812 after the injection valve 811.

The new fuel supply device for an invention-based fuel injector functions as follows. The pump 801 sucks the fuel 802 from the tank 803 and carries it to the gas separation chamber 805 until the vent valve 807 is closed by the float 806. The pump 810 draws the fuel at the bottom of the gas separation chamber 805 and 813 builds up the pressure required for the particular injection system before the pressure regulator. In its delivery characteristic the pump 810 is so designed that it raises the quantity of fuel required for the cooling and flushing of the injection valve 811 and delivers it via the condenser 81 4 to the gas separation chamber 805. When vapor bubbles 805*b* are carried into the gas separation chamber 805, the fuel level 805*a* falls, the float opens the vent valve 807 until the pump 801 has drawn sufficient additional fuel to restore the original level 805*a*. The vent valve 807 is in communication with the engine air intake 808, so that the fuel vapors exhausted from the air intake cannot escape unburned into the environment.

We claim:

1. Fuel injection device operating according to the solid-state energy storage principle, whereby a piston element carried in a pump cylinder of an electromagnetically driven reciprocating pump displaces the fuel to be injected in the pump area before the injection during a virtually resistanceless acceleration phase during which the piston element stores kinetic energy, and the displacement is suddenly stopped with means interrupting the displacement, so that a pressure impulse is produced in the fuel contained in a sealed pressure chamber due to the fact that the stored kinetic energy of the piston element is directly transferred to the fuel in the pressure chamber and whereby the pressure impulse is used for the injection of fuel by an injection device, characterized by the fact that the means for interrupting the displacement and producing the pressure impulse are arranged outside the leading contact area between the piston element and the piston cylinder of the reciprocating pump.

2. Device as per claim 1, characterized by the fact that the means for the interruption of the displacement and the production of the pressure impulse come in the form of a device having a stopping device (6, 50, 70, 90, 125, 218/223).

3. Device as per claim 2 characterized by the fact that the position of the stopping device (e.g. 37) can be varied.

4. Device as per claim 1, characterized by the fact that a volume storage element (6) is provided for the displacement of fuel during the acceleration phase.

5. Device as per claim 4, further characterized by an electromagnetic reciprocating pump (1) which is connected to an injection device (3) via a delivery line (2), whereby from the delivery line (2) a suction line (4) branches off and is connected with a fuel reservoir (5) and whereby the volume storage element (6)is connected to the delivery line (2) via a line (7).

6. Device as per claim 5, characterized by the fact that the pump (1) has a housing (8) accommodating a toroid coil (9), whereby in the area of the coil passage a rotor (10) is arranged which is a cylindrical body and is carried in a housing cylinder, located near the central longitudinal axis of the toroid coil (9) and is held by a pressure spring (12) in an initial position where it rests against the bottom (11*a*) of the housing cylinder, whereby to the front face of the rotor (10) on the injection nozzle side a delivery plunger (14) is attached which enters a cylindrical fuel delivery space (15) relatively deeply, this delivery space being arranged coaxial with the housing cylinder and in transfer connection with the pressure line (2).

7. Device as per claim 6, characterized by the fact that a non-return valve (16) is arranged in the suction line (4).

8. Device as per claim 4, characterized by the fact that the storage element (6) has a housing (22) in whose cavity a diaphragm (23) when stressed functions as the element to be displaced and which separates from the cavity a pressure-side space filled with fuel and when unstressed divides the cavity into two halves mutually sealed by the diaphragm, whereby on the side of the diaphragm away form the line 7 an empty space is arranged which has a domed wall (22*a*) as a stop for the diaphragm (23).

9. Device as per claim 8, characterized by the fact that on the side of the diaphragm away from the line (7), a spring (24) acting on the diaphragm is arranged in the empty space, whereby this spring functions as return spring for the diaphragm (23).

10. Device as per claim 5, characterized by the fact that in the pressure line (2) between the injection valve (3) and the pressure chamber before the branch lines (4, 7) a non-return valve (16)is arranged which in the space on the injection valve side forms an air chamber for the maintenance of a specific static pressure in the fuel.

11. Device as per claim 4, characterized by the fact that as displacement organ for the storage element (6) use is made of a storage piston (31) carried in a cylindrical housing (30) connected with the line (7), whereby the cylinder (30) provides an empty space (33*c*)into which the piston (31) can be displaced by the fuel.

12. Device as per claim 11, characterized by the fact that a discharge bore (32) is arranged in the area of the empty space (33*c*).

13. Device as per claim 12, characterized by the fact that in the empty space (33*c*) a pressure spring (34) is mounted which presses the piston (31) in its resting position against a housing wall (33*a*) on the pressure-side.

14. Device as per claim 11, characterized by the fact that in the empty space (33*c*) an axially adjustable step pin (37) for the piston which passes through the housing wall and is connected with an adjusting device outside the housing.

15. Claim as per claim 7 characterized by the fact that the fuel supply valve (16) is also designed as a storage element valve (50).

16. Device as per claim 15, characterized by the fact that the valve (50) has a cylindrical housing (51) in which a through-bore (52) has been made, which has a part (53) on the pressure-side and a part (53*b*) on the induction side, whereby between them there is a radially widened valve space (54) which accommodates a shut-off valve element (55) which consists in one piece of a circular disc (56) of large diameter and a circular disc (57) of small diameter, whereby the circular disc (57) is arranged on the side of the bore part (53) and whereby a valve body return spring (58) presses the valve element in resting position against an annular front face (59) of the valve space (54), this spring being braced on one side against the circular disc (56) and on the other against the bottom of an annular step (60) arranged centrally in the front face (61) opposite the front face (59) of the valve space (54), so that the circular disc (56) can come to rest against and seal the front face (61) of the valve space (54) and whereby the bore part (53) communicates with the valve space (54) via grooves or slots (62) arranged in the housing (51), these slots or grooves advantageously being formed so that they widen funnel-like towards the valve space (54).

17. Device as per claim 15, characterized by an electromagnetic valve (70).

18. Device as per claim 17, characterized by the fact that the valve (70) has in a valve housing (77) a toroid coil (78) in whose interior space a cylinder bore (74) is provided, accommodating a rotor (73), which is in connection with a spring-loaded valve plate (72) and has at least one bore (75) running at right angles to the longitudinal dimension of the rotor near the valve plate, whereby the rotor (73) is pressed by a spring (76) pressing against the plate (72), into a final position on the pressure-side, in which position the fuel is in communication with the fuel in the pressure chambers (15, 2) via the bores (75) and (74) and the pressure line opening (71).

19. Device as per claim 15, characterized by an integral storage element-supply device (90), having a housing (91) with a central longitudinal bore (92), which exits at one end via an opening (93*a*) into the pressure line (2) and at the other end into a cylindrical valve space (93), whereby moreover grooves (94) run from the bore (92) to the valve space (93) and whereby the valve element consists of two parts and comprises a cylinder (95) carried in the valve space (93), whereby in the cylindrical central stepped through-bore of this cylinder a piston is carried in a slidable arrangement and whereby the outer surface of the cylinder (95) has axial parallel slots (97) and whereby the cylinder (95) is pressed by a spring (98) into its resting position, where it is seated with its front face on the tank-side bottom of the valve space (93), into which a fuel line (99) forming from the fuel tank exits, and whereby in the bore accommodating the piston (96) there is a tank-side spring (100), which presses the piston (96) against the bottom of the pressure-side valve space (93), so that the bore (92) is covered, whereby in the tank-side interior space of the cylinder (95) a free space (95*a*) for the piston (96)is formed.

20. Device as per claim 6 characterized by the fact that the storage element (6) is of uniform construction with the delivery plunger (14) of the reciprocating pump (1).

21. Device as per claim 20, characterized by the fact that a storage piston (80) serves as storage element, whereby this piston is pressed on the pressure-side in a first central longitudinal stepped bore part (14*b*) of a stepped bore passing centrally through the piston (14) and the rotor (10) against a pressure-side stop of a spring (81), whereby the piston (80) in resting position protrudes with its front face into the pressure chamber (15) and the bore part (14*b*) accommodating the storage piston (80) continues in the delivery plunger (14) after a step (14*c*) towards the rotor (10) in a further stepped through-bore part (14*d*), against whose step (14*e*) a pressure spring (81) is braced and which spring presses against the rotor-side front face of the piston (80).

22. Device as per claim 4, characterized by the fact that a tank-side hydraulic valve is accommodated together with the pump (1) and the pressure line (2) in a common housing (121) and is a hydraulically controlled fuel supply valve (122)inserted in the fuel supply line, which automatically closes at a certain flow rate by the Bernoulli effect.

23. Device as per claim 22, characterized by the fact that the fuel flows through a gap (123) into a valve space (124) of the valve (122), in which between a valve cone (125) and the mating valve seat a narrow annular clearance has been left which can be adjusted by the required design of a spring (126) acting on the valve cone (125).

24. Device as per claim 22 characterized by the fact that the pressure line (2) leading to the injection nozzle is connected to the outlet of a non-return valve (127) which is also arranged as an integral part of the housing (121) and the fuel flow to the injection nozzle (3) runs via this valve.

25. Device as per claim 24, characterized by the fact that the non-return valve (127) has a valve cone (128) which by the force of a spring (129) is pressed against a mating valve seat, whereby the spring (129) is so designed that the valve (127) is closed when the pressure prevailing towards the pressure line (2) is below the value leading to ejection of fuel through the injection nozzle (3) connected direct to the valve (127).

26. Device as per claim 6, characterized by a hydraulic damping device for the rotor element (10) of the reciprocating pump.

27. Device as per claim 26, characterized by the fact that the hydraulic damping device is constructed like a piston cylinder arrangement, whereby on the rotor (10) there is a central cylindrical projection (10*a*) which in the last section of the rotor return movement fits into a blind cylinder bore (11*b*) in the bottom (11*a*) of the cylinder, whereby the rotor (10) has longitudinal slots (10*b*) which connect the space at the rear of the rotor with the space at the front of the rotor in the pump cylinder.

28. Device as per claim 26, characterized by the fact that the pump space (11) traversed by the delivery plunger (14) is connected before the piston (10) with the space (11) adjoining the rear of the rotor by bores (10*d*) which lead into a central transfer passage 10*c* in the area at the rear of the rotor into a central transfer passage (10*c*), whereby a central pin (8*a*) of a shock absorber (8*b*) protrudes with a cone point (8*c*) towards the opening of the transfer passage (10*c*).

29. Device as per claim 28, characterized by the fact that the central pin (8*a*) at the rear passes through a hole (8*d*) in the bottom (11*a*) which leads into a damping chamber (8*e*), whereby the pin (8*a*) ends in the damping chamber with a ring (8*f*) which has a larger diameter than the hole (8*d*) and whereby a spring (8*g*) braced against the bottom of the damping chamber, presses against the ring (8*f*) and whereby a passage (8*h*) connects the damping chamber (8*e*) with the rear rotor space (11).

30. Device as per claim 28, characterized by the fact that in the pin (8*a*) a displacement through-bore (8*i*) is centrally arranged and through which damping medium can be pressed into the transfer passage (10*c*).

31. Device as per claim 26, characterized by the fact that the rotor (10) during its return movement operates a pump device which simultaneously ensures damping of the rotor (10).

32. Device as per claim 31, characterized by the fact that an oil pump (260) is connected to the rear bottom (11*a*) of the pump housing (8), which pump has a housing (261)in whose pump space (261*b*) a pump piston (262) is arranged whose piston rod (262*a*) protrudes into the working space (11) of the rotor (10), whereby the piston (262) is under tension from a return spring (263) braced against the housing bottom (261*a*) near an outlet (264).

33. Device as per claim 32, characterized by the fact that the pump space (261*b*) communicates via an oil supply line (265) with an oil reservoir (266), whereby a non-return valve (267) is inserted in the oil supply line (265).

34. Device as per claim 27, characterized by the fact that the blind cylinder bore (11*b*) has a larger diameter than the diameter of the cylindrical projection (10*a*) and the projection (10*a*) or the blind cylinder bore (11*b*) has a circular sealing lip (10*e*) or (10*d*), whereby the circular sealing lips form the piston seal for the projection (10*a*).

35. Device as per claim 26, characterized by the fact that the rotor is designed as a pump cylinder (210), whereby the housing interior space (202) is divided by a ring extending radially inwards (203), into an interior area on the tank side and the side of the pressure line respectively and whereby on the pressure-side against a ring edge of the ring (203) there is inserted an annular ring (204) of a piston (205) of the reciprocating pump (1), whereby this ring sits form-locking and firm in this interior space and is clear of the ring opening (206) of the ring (203) and protrudes into the tank-side area of the interior space (202) where it engages a through-bore (217) of the rotor cylinder (210.

36. Device as per claim 35, characterized by the fact that the piston (205) is traversed by a through-bore (207) which widens in the tank-side area of the piston and there accommodates a non-return valve (208) which for the closing position is pressed towards the tank side against a valve seat (209*a*) by a coil spring (209).

37. Device as per claim 35, characterized by the fact that on the part of the piston (205) in the tank-side interior area of the interior space (202) sits form-locking and slidable the pump cylinder (210) of the reciprocating pump, which cylinder is pressed with its tan-side annular front face (214) against an annular step (213) in the interior space (202) by a coil spring (211) which at one end is braced against the ring (203) and at the other against an annular step (212) of the cylinder (210), whereby a valve nipple (215) rising above the annular front face (214) protrudes radially spaced some way into the interior space (202) which is radially narrowed here and whereby the annular front face of the pressure-side cylinder (210) is arranged at a distance from the ring (203) so that there is motion space for the cylinder (210).

38. Device as per claim 37, characterized by the fact that the cylinder (210) positioned form-locking at the inner wall of the interior space (202) has open-faced longitudinal axial parallel slots (216) in the surface and that the through-bore (217) passing through the pump cylinder (210) and accommodating the piston (205) contains on the tank side a tappet valve preceding the piston (205), whereby the tappet head (218) of this valve is arranged at a distance from the annular front face of the piston (205) in a short bore widening and its push rod (219) passes through the narrowed bore (217*a*) in the valve nipple (215)—braced against the inner wall of the bore (217*a*)—and protrudes into the narrowed interior space (202*a*).

39. Device as per claim 38, characterized by the fact that at the free end of the push rod (219) a dish (220) with holes (221) is attached, whereby the push rod (219) extends some distance beyond the dish (220) and strikes against the tank-side bottom (222) of the interior space (202*a*), whereby the length of the push rod (219) is chosen so that the tappet head (218) is lifted from its valve seat (223) of the narrowed bore (217*a*), so that a certain gap "X" is formed.

40. Device as per claim 39, characterized by the fact that a coil spring (224) stabilises the position of the tappet valve in the resting position of the reciprocating pump through the fact that the spring (224) is braced at one end against the annular front face (214) of the cylinder (210) and at the other end against the dish (220).

41. Device as per claim 39, characterized by the fact that axial parallel bores (225) extend from the bottom (222) into the bottom wall and exit into an axial valve space (226) where a valve head (229) pressed towards the tank by a coil spring (228) against a valve seat (227) is arranged, this valve head having slots (230) which can be covered peripherally by the valve seat (227), so that the valve can be opened against the force of the spring (228) by a pressure on the side of the tank connection and a passage is created from the valve space (226) to the bores (225).

42. Device as per claim 35, characterized by the fact that the piston (205)is formed in one piece with the front wall (200*d*) of the housing (200), whereby the static pressure valve (208, 209) is inserted on the pressure-side in a nipple (208*a*) before the piston (205) and covers the opening of the bore (207) passing through the pressure-side piston (205).

43. Device as per claim 42, characterized by the fact that the push rod (219) is relatively short and can only project beyond the annular front face (214) of the cylinder (210) by the valve clearance.

44. Device as per claim 43, characterized by the fact that the annular front face (214) strikes in the area of the front wall (200*c*) a plastic block (231) which has through-bores (232) which come out peripherally into slots (233) communicating with the tank-side interior space (202), whereby from the tank-side interior space (202) bores lead to the widened bore area of the bore (217) in the cylinder (210) and whereby the bores (232) exit into the axial valve space leading to the tank which valve space is accommodated in a nipple (226*a*).

45. Device as, per claim 44, characterized by the fact that the widening of the bore (217) in which the tappet head (218) is positioned, forms on the pressure-side an annular step (235) which in the resting position of the tappet valve is only a short distance away before the tappet head (218) and strikes the tappet head (218) when the tappet subject to inertia lifts from the valve seat during the return movement of the cylinder (210) and/or the valve during the return movement of the cylinder (210) should be bounced back from the plastic block (231).

46. Device as per claim 45, characterized by the fact that in the front surface of the annular step (235) recesses (235*a*) are provided and ensure an unobstructed flow of the fuel.

47. Device as per claim 44, characterized by the fact that the annual front face (214) is arranged very close to the surface of the plastic block (231).

48. Device as per claim 47, characterized by the fact that projecting bracing ridges (214*a*) are arranged on the annular front face (214).

49. Device as per claim 43, characterized by a rotor damping device near the free end of the push rod (219), whereby a flanged ring (219*a*)is arranged there which laterally engages the annular front face (214) some distance and can rest against the annular front face (214) and whereby there is in the surface of the plastic block (231) a recess (231*a*) matching the flanged ring (219*a*)into which the flanged ring (219*a*) fits more or less form-locking.

50. Device as per claim 49, characterized by the fact that the thickness of the flanged ring (219*a*) is slightly greater than the depth of the recess (231*a*).

51. Device as per claim 35, characterized by the fact that a bore (234)is arranged in the pressure-side of the front wall (200*d*) and that this bore leads from the pressure-side interior space (202) to the outside and on which advantageously on the outside a nozzle (237) with a through-bore (238) is fitted, whereby through the bore (236) and the discharge nozzle (237) during the starting phase of the pump (1) and the engine or continuously, fuel can be pumped away from the rotor cylinder (210).

52. Device as per claim 35, characterized by the fact that on the inner wall of the pressure-side interior space (202) a pressure spring (238*a*), braced against the front wall (200*b*), is arranged which is struck and compressed by an annular front face (239) of the rotor cylinder during the acceleration of the rotor cylinder (210).

53. Device as per claim 35, characterized by the fact that the cylinder (210) is located liquid-tight as a piston-like rotor element in the interior space (202).

54. Device as per claim 53, characterized by the fact that a piston (205*a*) partly positioned in the rotor cylinder bore (217) is mounted axially movable and is a part of the injection valve device (3).

55. Device as per claim 54, characterized by the fact that the injection valve device (3) has a valve cap (3b) screwed into the front wall (200*d*) of the housing (200) and engaging the injection valve side interior space (202), the piston (205*a*) in its resting position covers the injection nozzle bore (3*d*) with a front face (205*b*) of reduced diameter and the surface (205*b*) which is reduced in diameter, charges into the cylindrical part of the piston (205*a*) with a truncated cone (205*c*).

56. Device as per claim 55, characterized by the fact that the piston (205*a*) is pressed in the rotor cylinder bore (217) by a pressure spring (240) against the injection nozzle bore (3*d*), whereby the pressure spring (240) is braced at the other end against a partition (241) arranged in the rotor cylinder bore (217), whereby this partition divides the bore (217) into an area on the injection nozzle side and a tank-side area.

57. Device as per claim 56, characterized by the fact that at least one bore (242) leads from the annular front face (212) through the rotor cylinder (210) into the widened cylinder bore space of the tank-side area of the bore (217), where the tappet head (218) is located, and that a bore (243) runs through the rotor cylinder (210) from the area on the injection nozzle side of the bore (217)into the tank-side interior space (202), whereby the middle area of the rotor cylinder (210) sits form-locking and virtually liquid-tight against the inner wall of the interior space (202).

58. Device as claim 57, characterized by the fact that the rotor cylinder (210) has slots in the tank-side area of the interior space (202), whereby the slot passages rest against the inner wall of the interior space (202) and there form guideways for the rotor cylinder (210).

59. Device as per claim 35, characterized by the fact that the injection nozzle (3) is accommodated direct in the front wall (200*d*) of the housing (200) and has a valve cap (3*b*) with a valve seat (3*c*) for a tappet valve (244), whose valve head (245) is pulled against the valve seat (3*c*) from outside and whose push rod (246) passes through the cap bore (3*d*) following after the valve seat (3*c*) free or radially braced by ribs (247) and also passes free through the rotor cylinder bore (217) and ends a short distance before the widened area of the bore (217), in which the tappet head (218) of the tappet valve (218, 219) is accommodated, whereby at the free end of the push rod a ring (248*a*) with holes or radial recesses (248) is attached, against which on the side of the injection valve a pressure spring (250) is braced, which at the other end rests against the front wall (200*d*) of the housing (200) or the valve cap (3*b*), whereby the rotor cylinder (210) has only the through-bore (217*a*) and no radial slots, but rests form-locking and liquid-tight against the inner wall of the interior space (202) and whereby during the pump movement the tappet head (218) strikes the push rod (246) after a specific stroke distance.

60. Device as per claim 59, characterized by the fact that the push rod (246) of the tappet valve (244) is of shorter design and in the resting position of the pump (1) only reaches as far as the final part of the rotor cylinder bore (217), whereby a further pressure spring (251) presses from the tank side against the ring (248*a*) which is braced at one end against a wall (217*e*) with a central bore (217*d*), this wall subdividing the bore (217) into an area on the side of the injection valve and an area on the tank side which communicate through the bore (217*d*).

61. Device as per claim 1, characterized by an auxiliary starting device with a control valve which is connected to an atomizer (506) of the engine and receives fuel from the fuel tank (502) and whose flow resistance together with that of the atomizer (506) is so determined that at starting engine speed with the pressure delivered by a precompression pump (501) the fuel requirement for starting can be also covered without electrical energy supply to the injection device (504).

62. Device as per claim 61, characterized by the fact that after the fuel precompression pump (501) which is connected with the fuel tank (502) on the induction side, a branch line of the fuel line to the engine is provided, whereby in the de-energized state an injection device (504) connected to a generator (503) (the injection device being constructed in accordance with the invention and particularly in accordance with one of the invention-based embodiments) is inactive and the control valve (505) which may e.g. be electromagnetic is open for the fuel supply to the atomizer (506) on the engine (500).

63. Device as per claim 61, characterized by the fact that a hand pump (509) on the engine is used additionally during starting for the direct fuel supply to the engine via the atomizer (506) which is arranged in the connection line (511) from the pump (501) to the control valve (505), whereby the control valve (505)is triggered by the injection control (507) via a control line (510).

64. Device as per claim 61, characterized by the fact that the control valve (505) is arranged in the injection line (511) between the injection device (504) and the injection nozzle (508).

65. Device as per claim 64, characterized by a cutout in the line from the injection control (507) to the control valve (505).

66. Device as per claim 64, characterized by the fact that the invention-based auxiliary starting device is used for emergency running, whereby a metering valve (505) effects a fuel quantity variation.

67. Device as per claim 66, characterized by the fact that the metering valve (505) has a housing (520) into which a coil (521) is inserted which serves as a drive of a rotor (522) which is mounted slidable in a bore (523) of the housing (520) and is pushed in its resting position by a return spring (524) against an adjustable stop (525) arranged in the housing (520), while to this stop outside the housing a cable pull (526) is connected, whereby the rotor (522) has peripheral longitudinal slots (527) enabling communication of the fuel in the bore (523) between the front and the rear of the rotor (522) and whereby the bulb-shaped stop (525) passes through the housing front wall (520*b*) and in the housing (520) is pretensioned in relation to the housing front wall (520*b*) by a spring (528) and whereby a metering piston (527) is of uniform construction with the front face of the rotor (522) opposite the stop (525) and whereby this front face additionally is under tension from the return spring (524) which is braced at file other end against the front wall (520*a*) of the housing (520) and whereby the metering piston (527) protrudes with a tapering end into the delivery line (511) from which moreover a connection line (511*a*) branches off to the atomizer (506) and whereby the cable pull (526), connected to the stop (525) held by spring force against the rotor (522), is connected to the throttle valve (530).

68. Device as per claim 6, characterized by a circuit for driving the rotor excitation coil (9,600) which is connected to a power transistor (601) which via a measuring resistor (602) is grounded, whereby the output of a comparator (603) is hooked on to the control input of the transistor (601), and whereby a current set point is applied to the non-inverting input of the comparator (603), this set point being obtained from e.g. a microcomputer and whereby the inverting input of the comparator (603) is connected to the side of the measuring resistor connected with the transistor (601).

69. Injection nozzle for a device as per claim 1, characterized by a valve seat pipe (701) with a ring channel (708) at the end, a diaphragm plate (704) with a central hole, this plate being pretensioned towards the valve seat and covering the ring channel (708), possibly a plug insert (702) in the hole of the diaphragm (704), a spring ring (705) and a pressure line (706).

70. Device as per claim 1, characterized by a fuel supply device without a return line to the tank, whereby a second fuel pump, a gas separation chamber with float valve and a condenser are used.

71. Device as per claim 70, characterized by a gas separation chamber (805), into which via a line (804) fuel (802) is pumped by a pump (801), out of which line a pump (810) feeds fuel via a fuel line (809) to an injection valve (811), whereby a line (812) is led back from the injection valve (811) into the gas separation chamber (805) where a pressure regulator (813) and a condenser (814) are arranged, whereby in the gas separator (805) a float (806) is provided which operates a vent valve (807) which is installed in a discharge line (808) coming out into the gas separation chamber (805).

72. Device as per claim 71, characterized by the fact that the fuel line (812) comes out into the gas separation chamber (805) above the liquid level (805*a*).

73. Device as per claim 71, characterized by the fact that the vent line (808) comes out into the gas separation chamber (805) above the liquid level (805*a*).

74. Fuel supply device as per claim 71, characterized by the fact that the fuel line (804) comes out into the gas separation chamber (805) above the liquid level (805*a*).

75. Device as per claim 71, characterized by the fact that with the exception of the tank (803) all components of the fuel injection equipment are arranged in the engine compartment (815).

* * * * *

UNITED STATES PATENT AND TRADEMARK OFFICE

CERTIFICATE OF CORRECTION

PATENT NO. : 5,469,828

DATED : November 28, 1995

INVENTOR(S) : WOLFGANG HEIMBERG

It is certified that error appears in the above-identified patent and that said Letters Patent is hereby corrected as shown below:

Column 22, line 47, "forming" should read --coming--.

Column 26, line 29, "charges" should read --changes--.

Signed and Sealed this

Twenty-sixth Day of March, 1996

*Attest:*

*Attesting Officer*

BRUCE LEHMAN

*Commissioner of Patents and Trademarks*